US006290164B1

(12) United States Patent
O'Connor et al.

(10) Patent No.: US 6,290,164 B1
(45) Date of Patent: Sep. 18, 2001

(54) METHOD AND APPARATUS FOR SUPPLYING STRIP MATERIAL

(75) Inventors: Lawrence J. O'Connor, Winnipeg; Philip J. Fleury, St. Francis Xavier; Darrell Van Mol, Winnipeg, all of (CA)

(73) Assignee: KT Equipment (International) Inc., St. Michael (BB)

( * ) Notice: Subject to any disclaimer, the term of this patent is extended or adjusted under 35 U.S.C. 154(b) by 0 days.

(21) Appl. No.: 09/599,258

(22) Filed: Jun. 22, 2000

Related U.S. Application Data

(63) Continuation-in-part of application No. 09/532,307, filed on Mar. 22, 2000, which is a continuation-in-part of application No. 09/516,935, filed on Mar. 1, 2000.

(51) Int. Cl.[7] ..... B65H 18/08
(52) U.S. Cl. ..... 242/471; 242/564.5
(58) Field of Search ..... 242/471, 486.1, 242/541.3, 539, 564.5

(56) References Cited

U.S. PATENT DOCUMENTS

| | | | | |
|---|---|---|---|---|
| 3,885,749 | | 5/1975 | Skacel . | |
| 3,889,831 | | 6/1975 | Davis . | |
| 3,918,697 | | 11/1975 | Gregory . | |
| 3,920,136 | | 11/1975 | Talbert . | |
| 4,143,828 | | 3/1979 | Braun et al. . | |
| 4,266,899 | | 5/1981 | Skeem . | |
| 4,279,559 | | 7/1981 | Stumpf . | |
| 4,406,419 | | 9/1983 | Kotzur . | |
| 4,489,901 | * | 12/1984 | Andersen | 242/471 |
| 4,525,982 | | 7/1985 | Meier . | |
| 4,542,842 | | 9/1985 | Reba . | |
| 4,543,149 | | 9/1985 | Abe et al. . | |
| 4,575,988 | | 3/1986 | Meier . | |
| 4,587,790 | | 5/1986 | Muller . | |
| 4,676,496 | | 6/1987 | Honegger . | |
| 4,732,528 | | 3/1988 | Good . | |
| 4,746,076 | | 5/1988 | Tomma et al. . | |
| 4,746,078 | | 5/1988 | Setzke . | |
| 4,770,366 | | 9/1988 | Hood et al. . | |
| 4,802,636 | * | 2/1989 | Frick et al. | 424/471 |
| 4,901,935 | | 2/1990 | Reist . | |
| 4,928,899 | | 5/1990 | Reist . | |
| 5,031,381 | | 7/1991 | Focke . | |
| 5,067,871 | | 11/1991 | Hilber . | |
| 5,169,083 | | 12/1992 | Sannohe et al. . | |
| 5,333,803 | * | 8/1994 | Planeta | 242/564.5 |
| 5,377,932 | * | 1/1995 | Meschi | 242/564.5 |
| 5,397,424 | | 3/1995 | Sakano et al. . | |
| 5,480,086 | | 1/1996 | Nakashima et al. . | |

(List continued on next page.)

FOREIGN PATENT DOCUMENTS

| | | |
|---|---|---|
| 3741411 | 5/1989 | (DE) . |
| 3809943 | 6/1989 | (DE) . |
| 0744372 | 11/1996 | (EP) . |
| 0947457 | 10/1999 | (EP) . |

*Primary Examiner*—Emmanuel M. Marcelo
(74) *Attorney, Agent, or Firm*—Pillsbury Winthrop LLP

(57) ABSTRACT

A strip is wound at a winding location onto a winding support stand carrying a rotatable elongate support core while effecting a traversing movement of the strip back and forth along the core to form a large package of the strip of diameter up to 8 feet and of length tip to 8 feet. Such a package is supported on the stand and the core during transportion from the supply location to an end use machine and during unwinding until the core is emptied of the strip. The stand with the emptied core is returned from the end use location to the supply location. The stand can be reduced in effective size while the core remains attached during return by partial collapse and/or, stacking or nesting stands together. A sling attached to the stand can be provided to support the bottom of the package to prevent sagging of material.

15 Claims, 17 Drawing Sheets

U.S. PATENT DOCUMENTS

| | | | | |
|---|---|---|---|---|
| 5,626,307 | | 5/1997 | Smith . | |
| 5,673,869 | | 10/1997 | Honegger . | |
| 5,799,897 | | 9/1998 | Honegger . | |
| 5,803,448 | | 9/1998 | Stiel et al. . | |
| 5,806,787 | | 9/1998 | Schneider . | |
| 5,833,167 | | 11/1998 | Thuer et al. . | |
| 5,924,646 | * | 7/1999 | Pouya | 242/541.3 |
| 6,007,016 | * | 12/1999 | Helton | 242/471 |
| 6,027,066 | * | 2/2000 | Street | 242/539 |
| 6,047,917 | * | 4/2000 | Ekstrom et al. | 242/541.3 |
| 6,179,243 | * | 1/2001 | Granger | 242/564.5 |

* cited by examiner

METHOD AND APPARATUS FOR SUPPLYING STRIP MATERIAL

This application is a continuation in part of application Ser. No. 09/532,307 filed Mar. 22, 2000 which is a continuation in part of application Ser. No. 09/516,935 filed Mar. 1, 2000.

This invention relates to a method and apparatus for supplying a long strip of material to an end use machine.

BACKGROUND OF THE INVENTION

Strip material is required for many processes and for forming many products. One important aspect of supplying a strip material to an end use machine for the process or for manufacturing the end product is the packaging of a strip material into a suitable supply.

The supply preferably provides a long length of the strip thus reducing the inconvenience of replacing the supply package with a further package. The strip is preferably supplied in long length in order to avoid the necessity for splices in the strip. The package should not cause damage or distortion of the strip in a manner which prevents or inhibits its use in the end use machine.

One form of package which has been used for many years is that of the pancake roll in which the strip material is rolled in spiral fashion so that each turn of the strip lies directly on top of the previous turn to build up a pancake roll of a maximum diameter which can be achieved while retaining stability. This technique however allows the packaging of a very limited length of material so that replacement of the package is relatively frequent.

Another form of package is a traverse wound spool in which the strip is wound onto a spool while simultaneously the winding point is traversed axially of the pool. Using this technique relatively large spools can be formed thus significantly increasing the length of the strip on the package structure.

However one significant problem which arises is that of handling the package so as to allow it to be moved from the supply location where the package is formed to an end use location at the end use machine including the steps of unloading the package from a winding support stand, handling the package during transportation and storage and loading the package onto an unwind stand at the end use machine. These problems have significantly reduced the maximum size of package which can be formed using this technique. Generally the package is rotated so that it stands on one end during storage and transportation. However it is known to mount packages of this type in a cardboard stand which holds up the core during transportation and storage.

In previous examples, strip material is wound onto a structure having a diameter of the order of four to six feet and up till now this has been the maximum size package which can be accommodated.

Another technique which has been available for many years but which has recently received considerable attention is that of festooning where the strip is folded back and forth into a generally rectangular structure. This technique has considerable advantages in that it allows a relatively long length of the strip to be formed into a single package structure and in addition both ends of the strip are available so that each package can be spliced to a subsequent package for continuous supply of the strip. However some materials cannot accommodate folding or may be compromised by folding so that such materials are not suitable candidates for the festooning process.

The term "strip" used herein is not intended to be limited to any particular type of material and is not intended to be limited to a single layer since the strip may be formed by a number of overlying layers which may or may not be laminated together. The present invention is therefore not material specific although it may have more value in regard to wider and thicker materials where the size of a package structure is relatively large in order to accommodate a suitable length of the material on a single roll.

SUMMARY OF THE INVENTION

It is one object of the present invention, therefore, to provide an improved method of supplying a strip to an end use machine which allows very long lengths of the strip to be supplied in a very large package while protecting the package during storage and transportation against damage. It will be appreciated that damage to outside parts of a large package in view of its size will cause loss of a large length of the product. It is further object to minimize handling and other nonvalue added activity at the winding and unwinding locations. It is a further object to allow winding into an economically acceptable package structure of a material which is relatively thick or otherwise difficult to wind or fold.

According to a first aspect of the invention there is provided a winding support stand for supporting a package structure during winding of a strip into the package structure at a supply location, during transportation of the package structure from the supply location to an end use location and during unwinding of the package support structure for supply of the strip to an end use machine at the end use location, the stand comprising:

a stand base;

an elongate cylindrical support member mounted on the stand base for rotation about a longitudinal axis of the member for receiving thereon the strip to form the package structure and for unwinding of package structure to supply the strip;

a flexible sling for engaging and supporting an outer surface of the package structure to inhibit sagging of the package structure;

the sling having a first end support and a second end support each arranged parallel to the axis of the elongate member and each located at a height on the support stand at least as high as the axis such that the sling extends around substantially 180 degrees of arc of the package.

Preferably the first and second end supports are arranged such that the sling extends around the package over the angle substantially equal to 180 degrees and extends from the package substantially vertically upwardly therefrom.

Preferably the first and second end supports are each arranged inwardly of a vertical plane tangential to the package, below a horizontal plane tangential to the top of the package and above a horizontal plane tangential to the bottom of the package.

Preferably the first and second end supports are carried by support members which are attached to the stand base for transportation therewith at least during the transportation of the package.

Preferably the support members are collapsible by folding or by removal for separate storage to allow nesting of one support stand with another for return when the package is unwound.

Preferably one of the first and second end supports comprises a roller which is rotatable about its axis to effect winding of the sling onto the roller.

According to a second aspect of the invention there is provided a winding support stand for supporting a package structure during winding of a strip into the package structure at a supply location, during transportation of the package structure from the supply location to an end use location and during unwinding of the package support structure for supply of the strip to an end use machine at the end use location, the stand comprising:

a stand base;

an elongate cylindrical core mounted on the stand base for rotation about a longitudinal axis of the member for receiving thereon the strip to form the package structure and for unwinding of package structure to supply the strip;

the stand base including first and second end support arms each for supporting a respective end of the core;

first and second rails each connected to a bottom of a respective arm and each extending across the stand base from said one side of the core to the opposed side underneath the core for resting upon a floor surface;

each arm being cantilevered from the respective rail;

the rails being arranged to converge toward one another from a wider side of the stand base at the bottom of the arms to a narrow side of the stand base as the arms extend across underneath the core;

and the stand base being shaped by the arrangement of the arms and the rails to allow nesting of one stand base with another stand base by insertion of the rails at the narrower side between the rails at the wider side to a position in which the core of one stand base is parallel to and along side the core of the next adjacent stand base.

Preferably the rails are connected at the narrower side by a cross rail and wherein the bottom of the arms are connected at the wider side by a cross beam, wherein the cross rail passes underneath the cross beam into the nesting position.

Preferably the cross rail has slots therein for the forks of a forklift.

According to a third aspect of the invention there is provided a method for supplying a strip to an end use machine at an end use location comprising:

forwarding the strip from a supply thereof at a supply location;

providing at the supply location a winding support stand having an elongate support core mounted on the stand for rotation about a longitudinal axis of the core;

causing a rotation of the core about the axis while effecting a traversing movement of the strip back and forth along the core so as to effect winding of the strip onto the core to form a package of the strip;

effecting transportation of the package structure from the supply location to the end use location;

causing unwinding of the package structure at the end use location so as to supply the strip to the end use machine;

providing at the end use location an end use machine;

at the end use location locating the package structure at a position remote from the end use machine;

and transporting the strip from the package structure to the end use machine through a transportation duct;

and providing in the duct an air flow therethrough tending to carry the strip on a layer of air within the duct.

Preferably the duct is a tube surrounding the strip.

Preferably the duct includes a permeable sheet over which the strip passes with air flowing through the sheet to form said layer of air.

Preferably there is provided an additional air flow system for threading the strip through the duct.

Preferably the sheet includes one way fibers tending to cause movement of the air and strip downstream of the duct.

Preferably the package structure is maintained supported on the winding support stand during said transportation and said unwinding until the elongate member is emptied and effecting a return of the winding support stand with the emptied elongate member from the end use location to the supply location.

Preferably the winding support stand allows movement between the cradle and the elongate member such that the package structure is free from contact with the cradle during said winding and said unwinding. During the rotation necessary for winding and unwinding, the package is preferably driven by a belt arrangement which is located underneath the package and thus acts to support the package no sagging can occur. As the cradle is moved out of the way at this time, the package must be free to rotate.

Preferably the cradle is formed of a flexible sheet material so as to follow the shape of the package structure. The sheet is thus supported at its ends at points spaced around the package and is curved around the package to provide support over an arc of the package. This also ensures proper support in a situation where only a part diameter is formed for example due to machine failure. The cradle may also be formed of a rigid sheet of metal. It can also be a sheet or plate of flexible material such as rubber. The cradle may also be formed of separate bars or panels provided enough of the package is supported to prevent sagging or distortion or creasing. The package structure is thus substantially cylindrical and the cradle is arcuate with a radius of curvature which can adjust automatically or otherwise to be equal to that of the peripheral surface of the package structure and a length substantially equal to a length of the package structure.

Preferably either the elongate member or core can be lowered or the cradle is arranged to be raised to provide contact between a peripheral surface of the package structure and the cradle when said winding is complete. This is preferably achieved by raising the cradle on hydraulic cylinders forming part of the stand, but to reduce complication, the arms supporting the cylindrical spool on which the package is formed may be lowered to gently lower the package onto its cradle which remains fixed on the base for support during storage and transportation. In another arrangement, the cradle may be formed by a flexible sheet which is carried on rollers which can be located in contact with the package periphery and the sheet tightened between the rollers to press up against the outside periphery of the package.

In accordance with an important preferred feature, the support stand is slightly wider and longer than the package structure to provide protection therefor.

Preferably the elongate member or core is carried on the winding support stand during winding, transportation, unwinding and return, that is the core forms an integral structure which remains in place at all times and there is no separate element which must be separately stored or transported. Collapse or stacking is therefore a simple operation without separate pieces and the whole stand remains intact but reduced in dimension for return. Thus the core comprises a rigid cylindrical body on which the strip is directly wound. The core is preferably of large diameter for example as much as twelve or even twenty four inches to reduce ending forces on material which may be damaged.

Preferably the winding support stand includes a rigid base and a pair of support frame elements arranged at respective ends of the elongate member and wherein the support frame elements with the core which remains carried thereby are stacked or meshed with other stands for the return trip.

This arrangement is preferably proposed for very large packages where the package structure has a diameter of greater than six feet and preferably of the order of eight feet and a weight preferably greater than 1000 lbs and up to 3000 lbs or even as much as 3 tons. Such packages can be transported side by side while substantially filling the width of a legal transportation container or truck. However the size of the package can of course be smaller. Such a large package structure allows the use where necessary of a larger core of for example twelve inches in diameter and even as much as twenty four inches and this overcomes problems of winding thicker or otherwise difficult to wind materials because the initial radius of curvature is reduced. Such a large core is uneconomical in conventional size packages since the amount of material wound is too small.

Preferably the package is driven during winding and unwinding by an external drive member arranged to contact an outer peripheral surface of the package structure. The drive is preferably separate from the winding support stand and thus is not transported with the winding support stand but it may be an integral structure with the stand. Preferably the drive is located underneath the package to provide support to prevent distortion by gravity and thus passes upwardly from below floor level between side rails of the stand. However the driving system may form a part of the stand and is thus moved with the stand. In this arrangement, the cradle may form a belt mounted on rollers which is driven to effect drive to the package. Power to the drive or to raising and lowering motors on the stand is supplied by a connection which is connected at the supply or end use location when the stand reaches its destination.

Preferably the winding support stand includes a rigid base which is provided with an arrangement for moving the base which is either receptacles thereon arranged such that the base and the package thereon can be engaged and lifted by the forks of a fork lift system or wheels or abutments for engaging transportation rails on which the stand is moved from place to place.

Preferably the dimensions of the stand and package are such that, while the stand is wider and longer than the package to provide the necessary support and to held protect the package against impact damage from adjacent packages, the stand is of a size such that it can just be received across the width of a standard transportation container or truck. In North America, such a maximum width is presently eight feet leading to a length of the package of the order of seven feet, bearing in mind clearances for the structure of the stand. Provided the package is not supported at a significant height above the ground, such containers can received the maximum diameter of eight feet approximately. This orientation of the package and its maximum diameters maximize the length of material stored.

BRIEF DESCRIPTION OF THE DRAWINGS

Embodiments of the invention will now be described in conjunction with the accompanying drawings, in which.

In the drawings like characters of reference indicate corresponding parts in the different figures.

DETAILED DESCRIPTION

Figure 1:
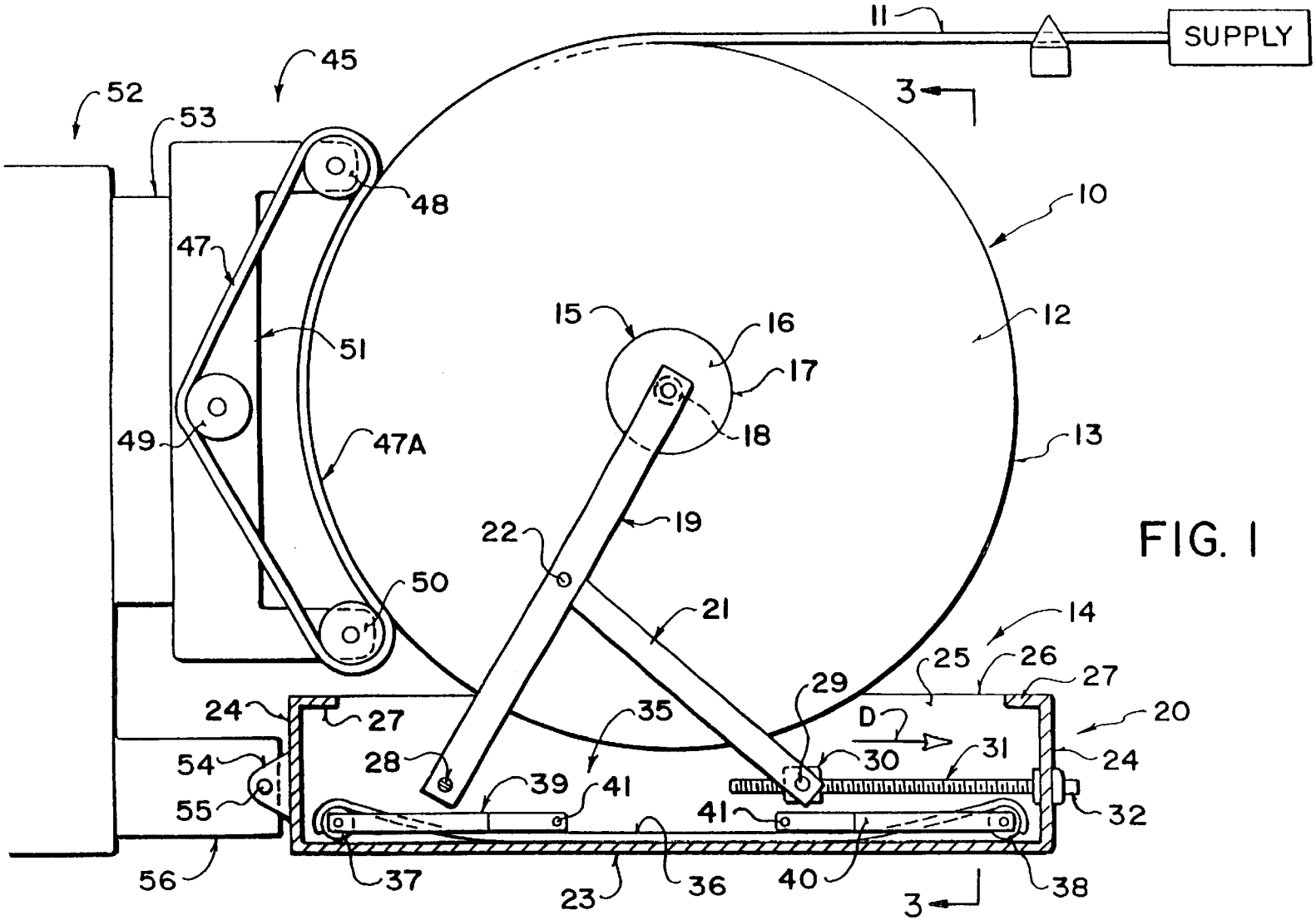
FIG. 1 is a cross sectional view of a method and apparatus for winding a strip onto a spool for use in a method of supplying the strip according to the present invention.
Figure 2:
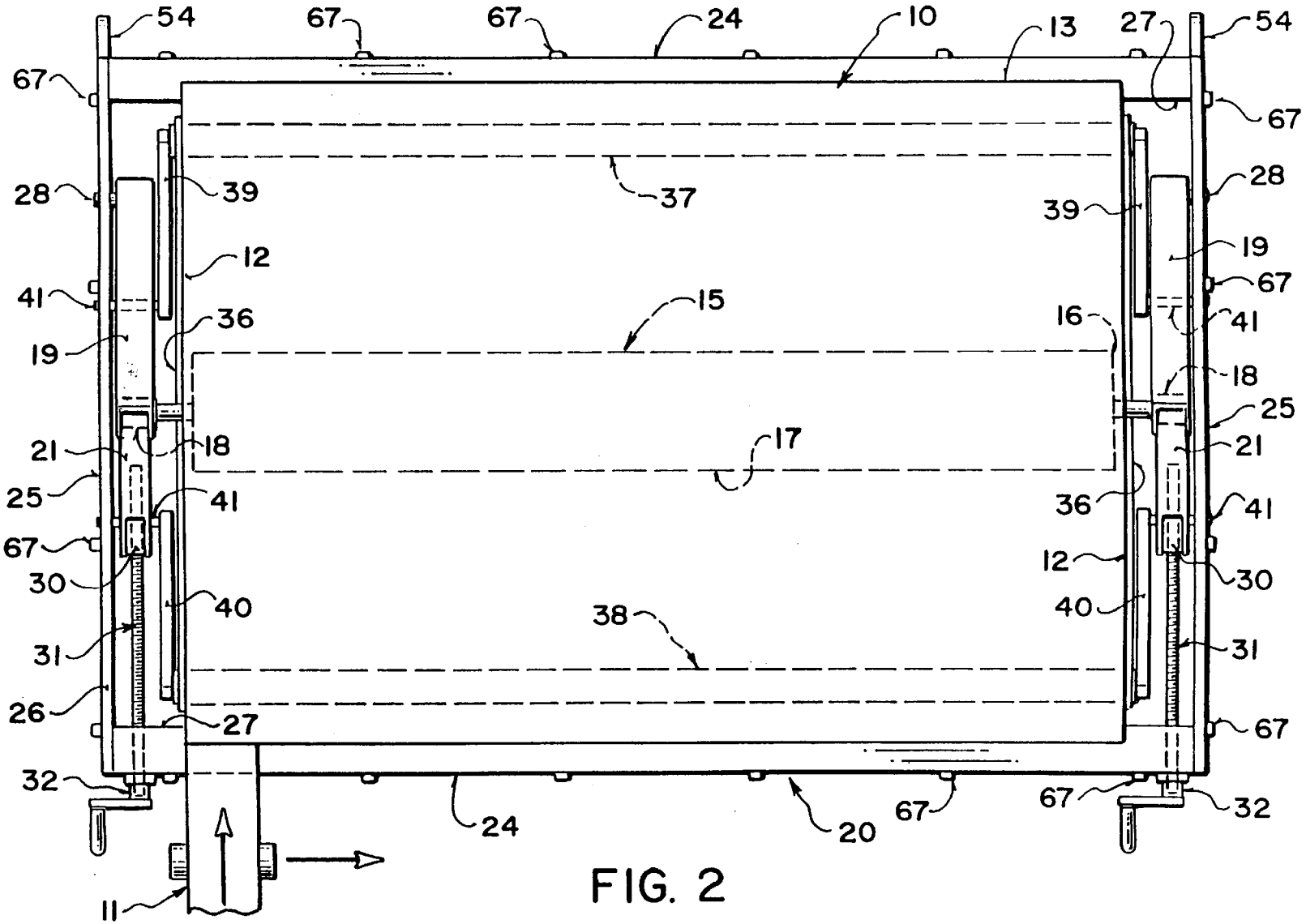
FIG. 2 is top plan view of the apparatus and spool of FIG. 1.

A package 10 is formed from a strip 11 in which the package when completed is cylindrical with generally flat ends 12 and a peripheral surface 13. The package has a width greater than the width of the strips so that the strip is traversed back and forth across the width of the package. The system for effecting the traversing movement is well known to one skilled in the art and is therefore shown only schematically. The completed package is shown in FIGS. 1, 2, 3 and 4 and is mounted on a support stand 14 which carries the package during the winding action forming the package, during transportation, during storage and during unwinding or unwinding of the strip at the end use location.

The support stand 14 comprises an elongate package support member 14 in the form of a cylindrical roller having ends 16 and a cylindrical peripheral surface 17. The roller has a length substantially equal to the width of the package and has a diameter arranged such that the strip can be curved around the outside surface at a radius of curvature equal to that of the outside surface without crimping or damaging the material. The roller 15 is mounted for free rotation in bearings 18 supported upon a pair of arms 19. Each of the arms 19 is carried on a stand base 20 from which the arm stands upwardly to the roller at its upper end. The arms 19 are braced by inclined struts 21 extending from a pivot 22 on the arm 19 down to the stand base 20.

The stand base 20 comprises a rectangular box or container defined by a horizontal bottom wall 23, two upstanding sides 24 and two upstanding ends 25. The sides and ends have a common height terminating at an upper edge 26 forming a top surface of the box. The sides 24 each include an in-turned flange portion 27 which extends partly across an open top of the box so as to form upper surface portions lying in the open upper surface of the box.

The arms 19 are each pivotally mounted on a pivot pin 28 carried on the respective side 25. Similarly, the struts 21 are pivotally mounted on a pin 29 at the respective side 25.

The arm 19 and the roller 15 can be folded into a collapsed position contained within the box. The height of the box is selected so that the roller 15 is wholly contained above the bottom wall 23 and below the top surface 26. As the roller has a length less than the space in between the arms, it is received between the arms when in the collapsed condition of FIG. 5.

Various different arrangements for effecting the movement of the arms into the collapsed position can be provided including hydraulic or pneumatic cylinders. In the embodiment shown there is provided a ball nut 30 on the pivot pin 29 which is driven in a direction D by a screw 31. The screw can be actuated by a motor contained within the box or can be actuated by an external drive mechanism at a connector 32 for example a hand crank or an external source of power available at the supply location or the end use location.

Thus the height of the roller 15 from the stand base can be adjusted slightly by adjustment movement of the strut 21. In addition the roller can be moved from the raised position shown in FIG. 1 to the collapsed position shown in FIG. 5. In the collapsed position both of the arms 19 both of the struts 21 and the roller are wholly contained within the box forming the stand base so nothing projects out of the box.

Figure 4:
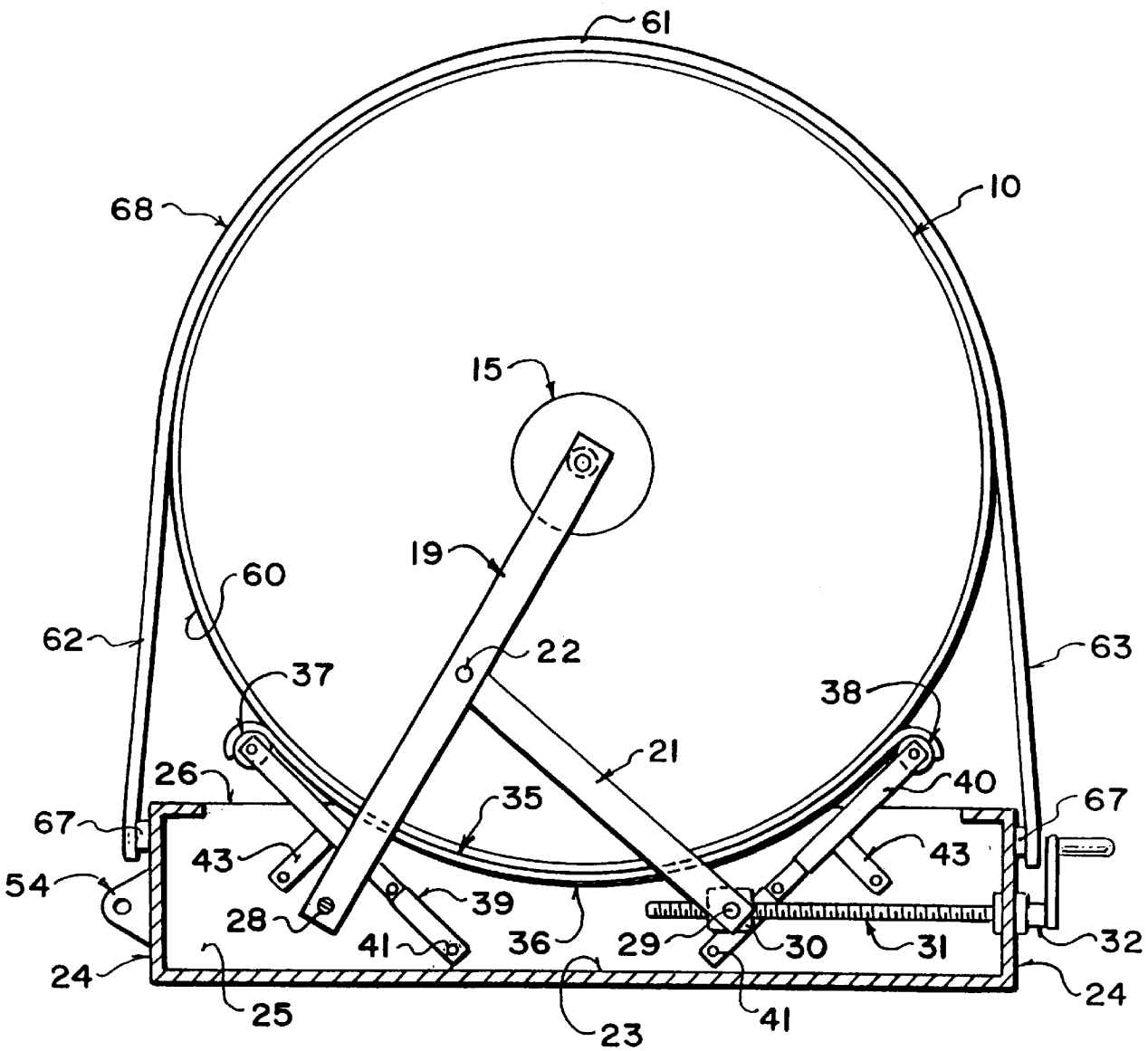
FIG. 4 is a cross sectional view similar to that of FIG. 1 showing the completed spool and stand wrapped for transportation.

As shown particularly in FIGS. 1 and 4, there is provided a support cradle 35 which can be moved from a collapsed condition at the bottom of the box as shown in FIG. 1 to a raised sport position as shown in FIG. 4. The cradle comprises a flexible sheet material 36 connected between two end rollers 37 and 38. Each of the rollers is mounted on a respective support arm 39, 40 pivotally mounted by a pin 41 to the respective side 25. The sheet material 36 has a length so that it extends along the full length of the cylindrical package. The length of the flexible sheet between the two rollers 37 and 38 is arranged such that with the rollers 37 and 38 in the raised position shown in FIG. 4, the length of the sheet is such that it follows the curvature of the outside periphery of the package. Thus the bottom part of the outside surface of the package is cradled on the sheet and is supported thus reducing or preventing the tendency of the package to sag which might occur where the package is only supported by the central roller 15.

During winding and unwinding of the package, the cradle is collapsed into its stored position at the bottom of the box. When the winding is completed, the cradle is moved into the raised position so as to act as a support for the package and to maintain that support during storage, handling and transportation of the package while supported on the stand.

Raising and lowering of the cradle can be effected by powered mechanisms such as pneumatic or hydraulic cylinders or by electric drive motors acting through a suitably designed linkage on the arms 39 and 40.

In the embodiment shown, the arms are raised manually and are held in the raised position by latches 43. Thus when winding is complete, the cradle is raised manually and the latches moved into place to hold the cradle in its raised position. In this position, the roller 15 can be lowered slightly on the arms 19 so as to apply a part of the load from the package onto the cradle so that the package is supported in part by the cradle and in part by the roller 15. When the package is due to be unwound, the cradle can be collapsed simply by removing the latches from their latch position so that the arms and the sheet move downwardly into the retracted position at the bottom of the box where the package is then free from support for unwinding.

The package is rotated at the supply location by a drive mechanism 45. A similar or identical drive mechanism 46 is provided at the end use location. Each of the drive mechanisms 45 and 46 is shown only schematically but includes a drive belt 47 mounted on three rollers 48, 49 and 50 carried on a support frame 51. The three rollers are arranged at the apexes of a triangle with a part of the periphery of the surface of the package between the rollers 48 and 50. The drive belt 47 thus wraps around the three rollers and forms a drive portion 47A in contact with the outside surface of the package between the rollers 48 and 50 which thus acts to drive rotation of the package at a required rate. One of the rollers is driven and the other rollers are idlers. The drive is controlled by a control system in conjunction with the drive to a supply or take up system for the strip so that the package is driven at the required rate to match the speed of movement of the strip toward or away from the package.

The frame 51 is mounted upon a support assembly 52 forming part of the structure at the location concerned. The frame 51 can be moved forwardly and backwardly by a drive mechanism shown schematically at 53 which acts to move the frame horizontally.

A registration system is provided by which the stand base is connected to the support 52. In the embodiment shown the registration system comprises a pair of lugs 54 which engage pins 55 carried by a suitable bracket 56 of the support structure 52. The belt portion 47A is arranged so that it can contact and curve around the roller 15 at the commencement of winding of the package so as to drive just the roller as the strip is applied to the roller in the winding action. As the package grows, the drive system 53 retracts the frame 51 so as to move it gradually away from the roller to accommodate the increasing size of the package until it reaches the maximum diameter of the package as determined by the control system. The use of a belt ensures a long length of engagement on their package at all times. The belt therefore provides a large area of engagement which ensures that the package is driven at the required rotation despite the very heavy weight of the package in its finished condition at the maximum diameter.

It will be appreciated that not all of the length 47A of the belt engages the package at all diameters of the package and that the length of the belt is arranged so that the whole of the portions 47A engages the surface of the package and follows the curvature of the surface at the maximum diameter.

During winding, the strip is supported by a lay-on roller as it is applied to the outside surface of the package. Traverse movement can be effected by moving the package or more preferably by moving the lay-on roller.

When the winding as shown in FIG. 1 is complete, a shrink wrap material 60 is introduced onto the package so as to follow around the package and pass underneath the belt 47 so that a number of turns of the wrap material are engaged around the package to provide a protection for the outside surface of the package. The ends remain exposed.

Figure 3:
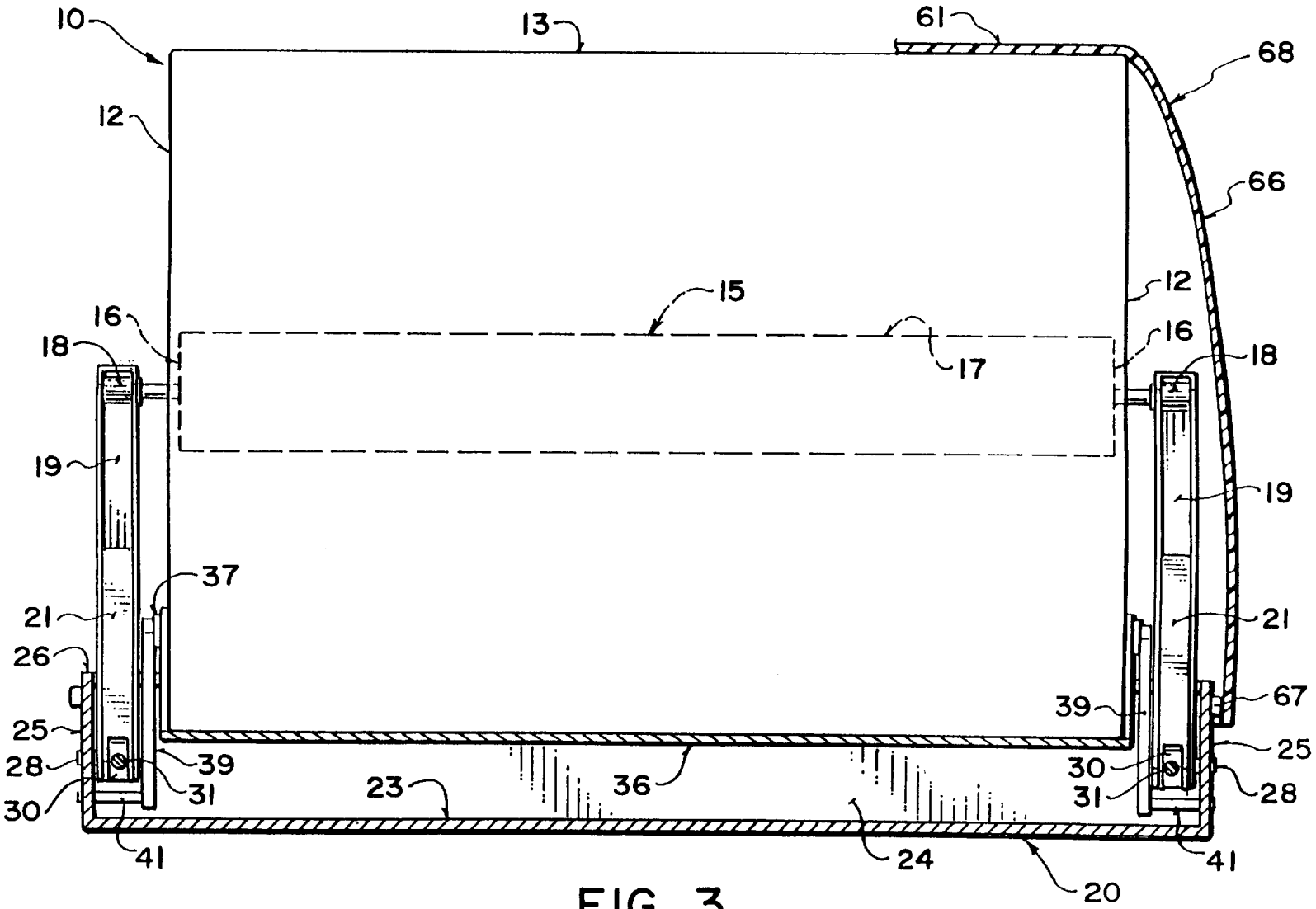
FIG. 3 is a cross sectional view of the apparatus and spool of FIG. 1, the cross section being taken along the lines 3—3 of FIG. 1.

Yet further, a full cover 68 for the whole of the package is engaged over the package both around the peripheral surface of the package and over the ends of the package. The cover can be of a re-useable flexible fabric material such as vinyl and includes an upper part-cylindrical section 61 and two depending sides 62 and 63 which extend from the package downwardly into engagement with the stand base where they are attached to the side walls 24 by suitable fasteners 63. Such fasteners may be snap clips or other alternatives well known to one skilled in the art. The cover also includes ends 66 which engage similar fasteners 67 on the ends 25 as shown in FIG. 3. Thus the whole of the package is fully enclosed by the box defining the stand base and by the flexible cover. The cover can also be disposable such as heat shrink or stretch wrap materials.

When the package reaches the end use location, it is moved to the registration position using the lugs 54 and the cover is removed. The cover as indicated at 68 in FIG. 5 can then be stored within the box for the return to the supply location for the manufacture of a further package. In the embodiment shown the cover can be simply folded or rolled or inserted into the hollow area of the box between the arms 19. The shrink wrap coating is of course discarded.

In an alternative arrangement (not shown) the loose or separate cover 68 can be replaced by a two part collapsible clam shell arrangement mounted on folding arms so that it is movable from a stored condition within the stand base upwardly and over the top of the package to join together across the top of the package thus fully enclosing the package. This avoids the provision of a separate or loose piece which may be lost and ensures that the cover arrangement is maintained at all times with the stand. Power erection of the cover can be provided in the form of or similar to the convertible roof of an automobile. A suitable zipper or other connector around the joint line between the two clam shell halves can be provided to ensure complete seal of the cover over the package. When the zipper is opened, the cover parts can be collapsed back into the box so they are out of the way of the unwinding action.

Figure 5:
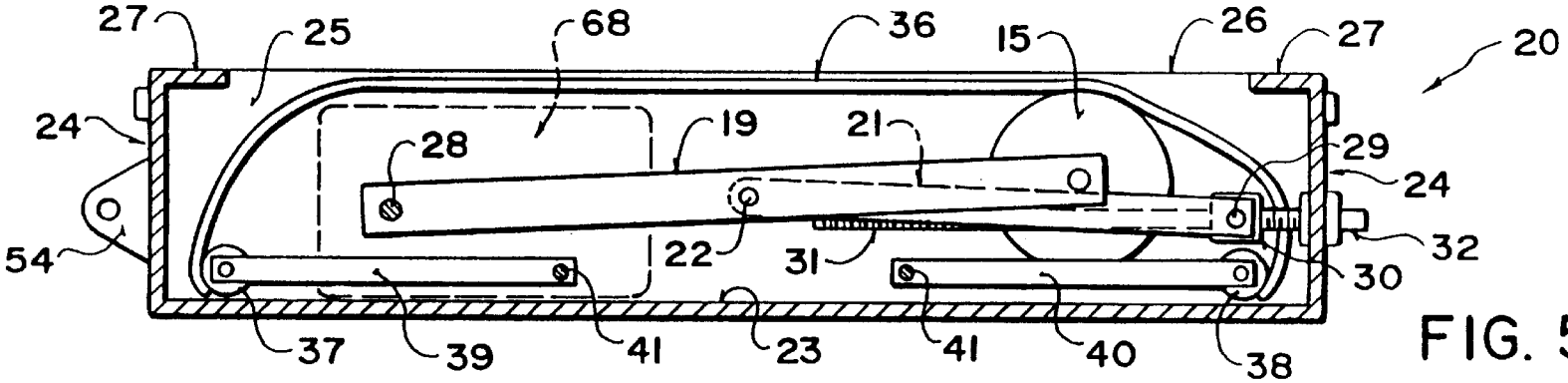
FIG. 5 is cross sectional view similar to that of FIG. 1 showing the stand in a collapsed condition after the strip has been unwound.
Figure 6:
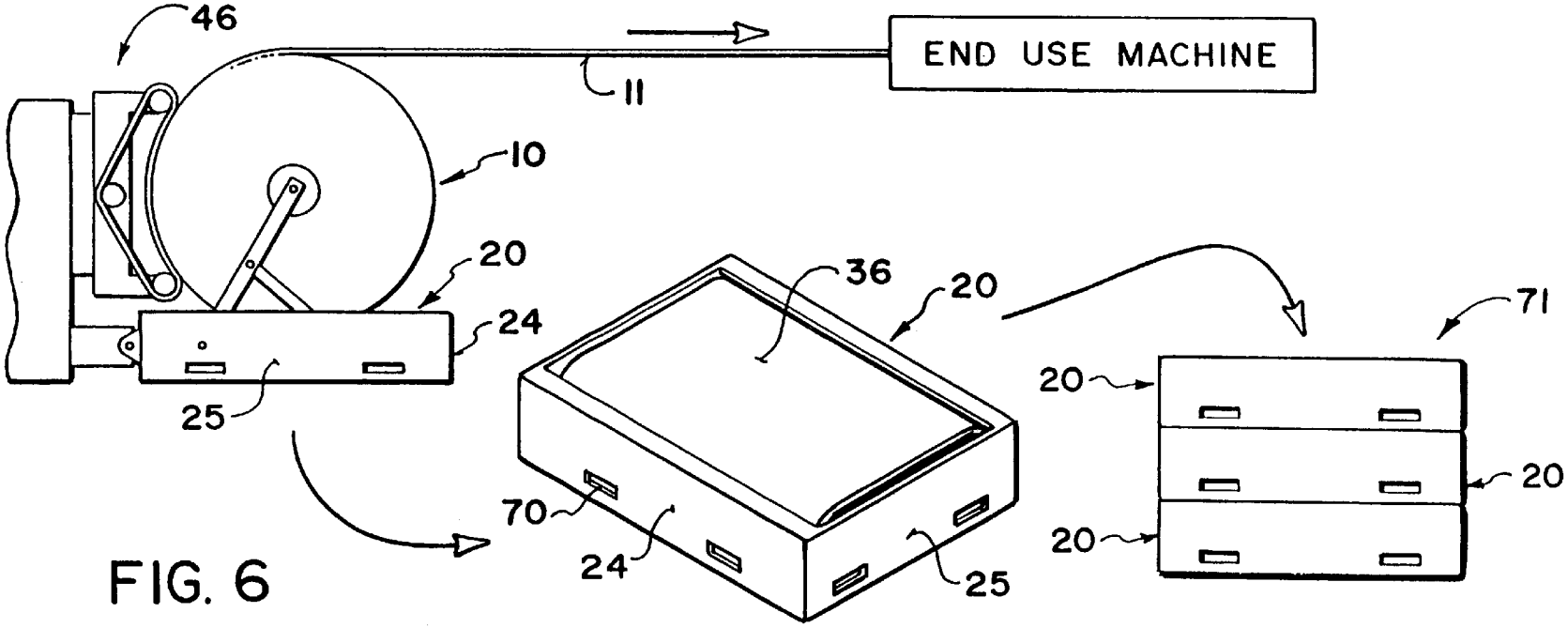
FIG. 6 is a schematic illustration showing the steps of unwinding at the end use machine, collapsing of the stand and stacking a plurality of stands for return tot he supply location.

As shown in FIG. 5, the cradle 36 can be used as a partial cover for the open part of the box in that the arms 40 can be raised allowing the roller 15 to collapse to a position underneath the cover sheet 36 whereupon the rollers 37 and 38 are moved toward the bottom wall of the block thus covering all elements within the box. The rolled cover 68 is inserted underneath the cradle again to be covered by that cradle.

In a further alternative arrangement (not shown) a pair of rigid cover panels are hingedly mounted on the top of the box and movable to a closed position meeting across the middle of the box. The cover panels ensure that the whole box is closed to keep the contents clean in the return collapsed condition and to assist in stacking. The cover panels can be opened to allow the roller 15 and supporting arms to be erected and moved out of the way to allow winding, transportation and unwinding of the package on the stand.

The sides 24 and the ends 25 each include slots 70 for conventional fork lift handling of the stand base both in the collapsed condition of FIG. 5 and while supporting the package. Thus conventional handling techniques can be used to move the emptied stand from the unwind assembly 46 and to stack the emptied stand into a stack of the stands as indicated at 71.

During transportation of the stand and the package thereon in the covered condition of FIG. 4, the dimensions of the stand base are arranged so that the stand base with the package thereon span across the full legally allowable width of a transportation truck or container thus substantially filling the width of the transportation container. A number of such packages are therefore arranged side by side each behind the next thus substantially filling the container by the packages.

Thus the package has a length which is slightly less than 8 feet so as to accommodate the support mechanism at the ends and maintaining a total width equal to 8 feet which is a maximum allowable load width. The package also has a diameter which is preferably of the order of eight feet since this provides a height approximating to the maximum allowable height. Such a dimension of package will for many suitable materials such as bulky or fibrous materials provide a total weight of the order of 1000 to 3000 lbs. This weight approximately matches the corresponding volume allowable so as to maximize the efficiency of use of the volume of the transportation container and allows maximum use of the volume by matching the dimensions of the container known generally as "cubing".

The packaging system described above can be used for individual or single strips. The type of material is not limited to specific materials provided that they can accommodate the forces involved and can allow formation of a large package which maintains its stability.

Figure 8:
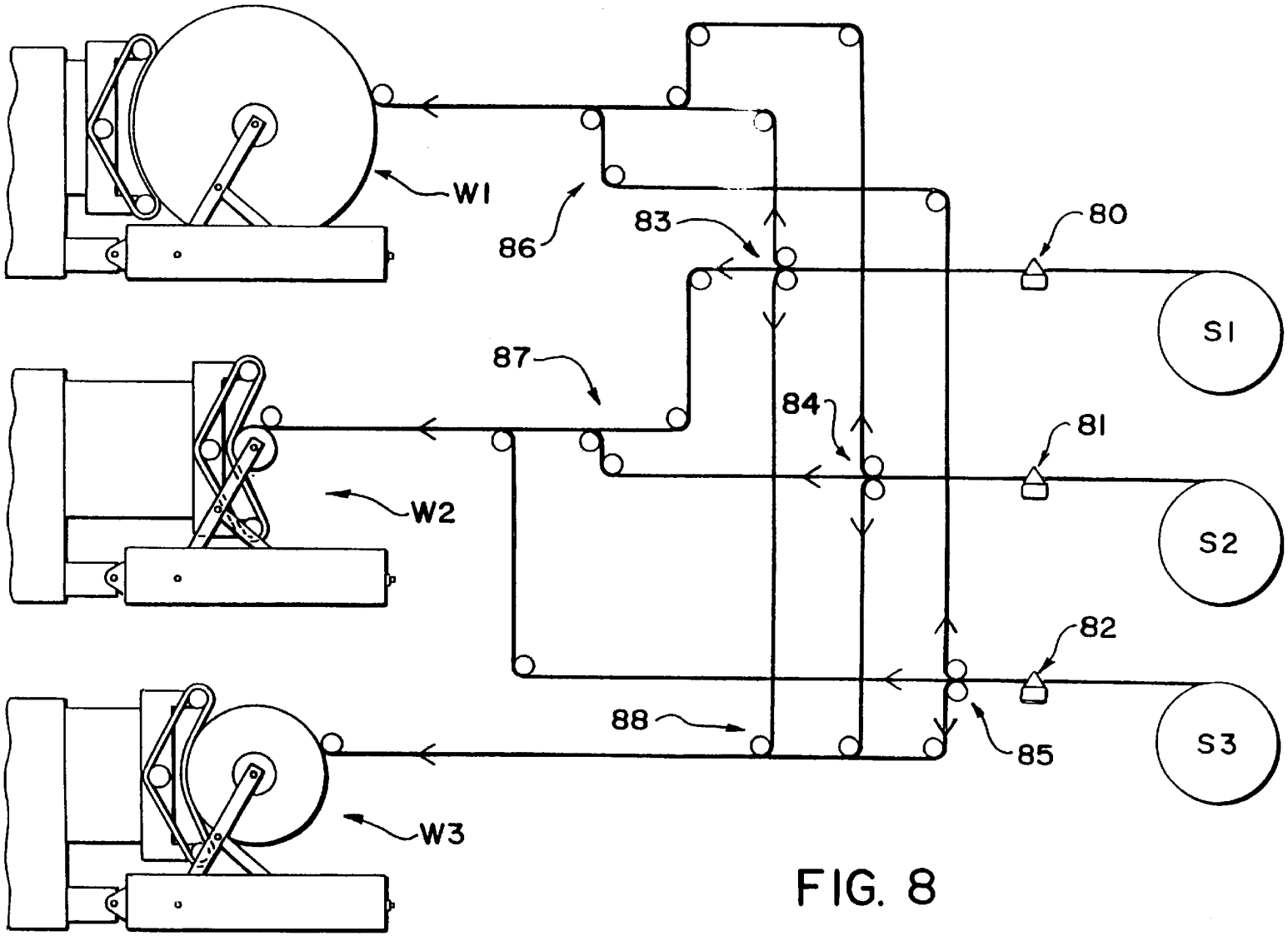
FIG. 8 is a schematic illustration showing the steps of winding a plurality of rolls side by side from a strip material including a plurality of overlying layers.
Figure 9:
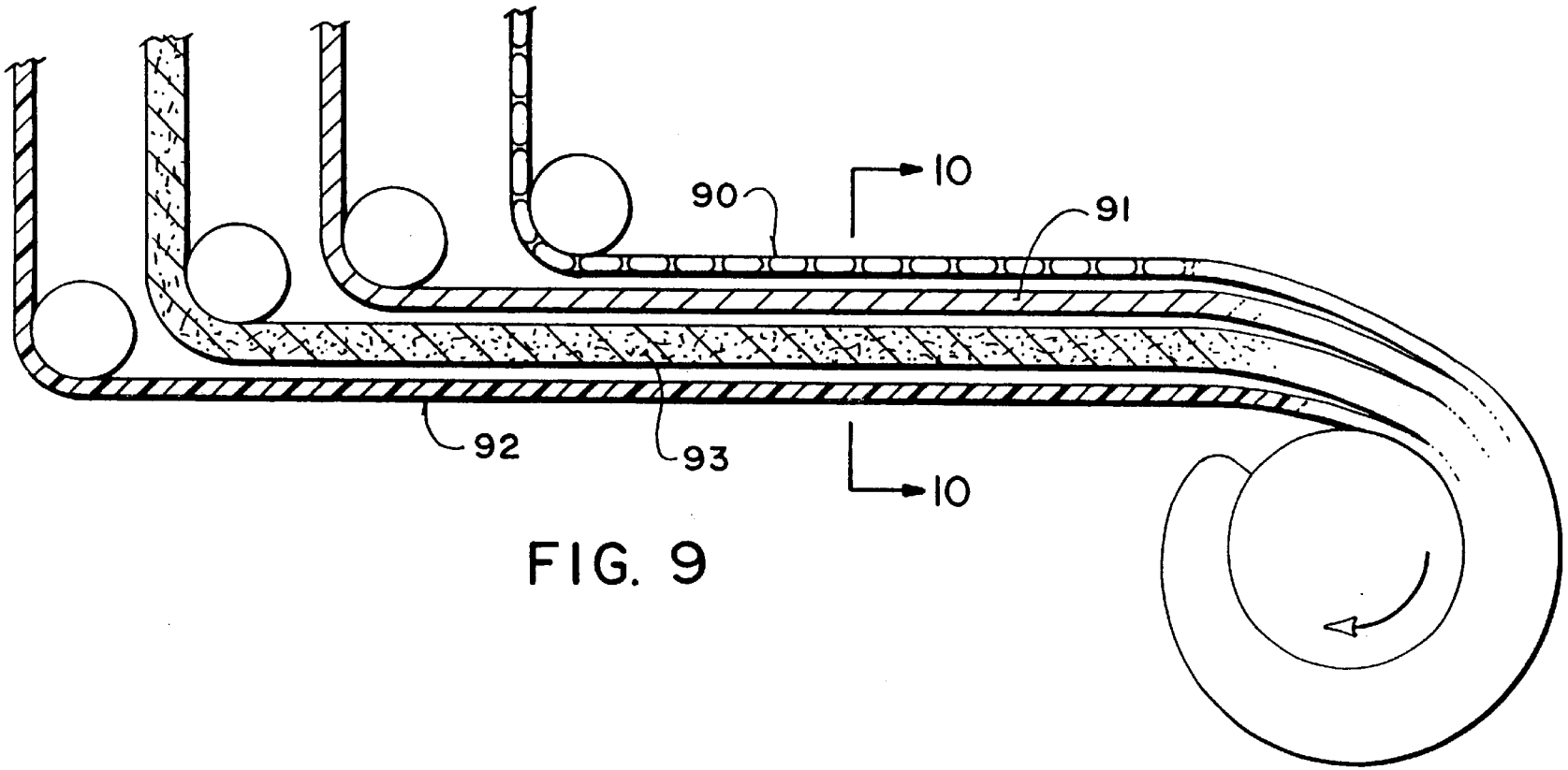
FIG. 9 is a schematic cross sectional view showing the assembly of a plurality of overlying layers for forming the strip material.
Figure 10:
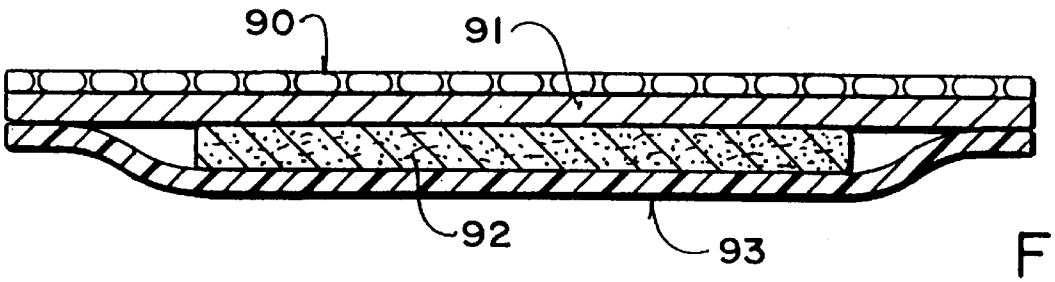
FIG. 10 is a schematic cross sectional view along the lines 10—10 of FIG. 9.

In FIGS. 8, 9 and 10 is shown an arrangement in which the packaging system is used for a plurality of overlying materials. Thus as shown in FIG. 8 three materials are supplied on master rolls S1, S2 and S3. The materials are different for a different purpose and are intended to be used together in the end use machine. In the process of FIG. 8, each supply sheet is slit at a respective slitter 80, 81, 82 to form a plurality of slit strips. The slit strips are then divided at a dividing system 83, 84 and 85 respectively into a plurality of separate slips for supply to separate winding stations W1, W2, and W3. The three separate materials are then assembled each on top of the next by a series of guide rollers 86, 87, 88 so that each strip lies directly on top of its next adjacent strip for supply simultaneously to the package for winding onto the package in overlying arrangement.

This arrangement is also shown in FIG. 9 where there are four layers. In the example shown, the four layers are respectively a perforated layer 90, an acquisition layer 91, an absorbent layer 92 and a backing plastics sheet 93. These particular layers are well known in the construction of diapers or other absorbent products. In the arrangement of the present invention, the materials could be supplied independently on separate packages. Alternatively in the arrangement shown in FIGS. 9 and 10 the materials are assembled together into a stack of the layers and wound together onto the package. The materials are slit before collation since they may be of different widths as shown. The materials may be connected by bonding together or may be separate and merely stacked.

Figure 7:
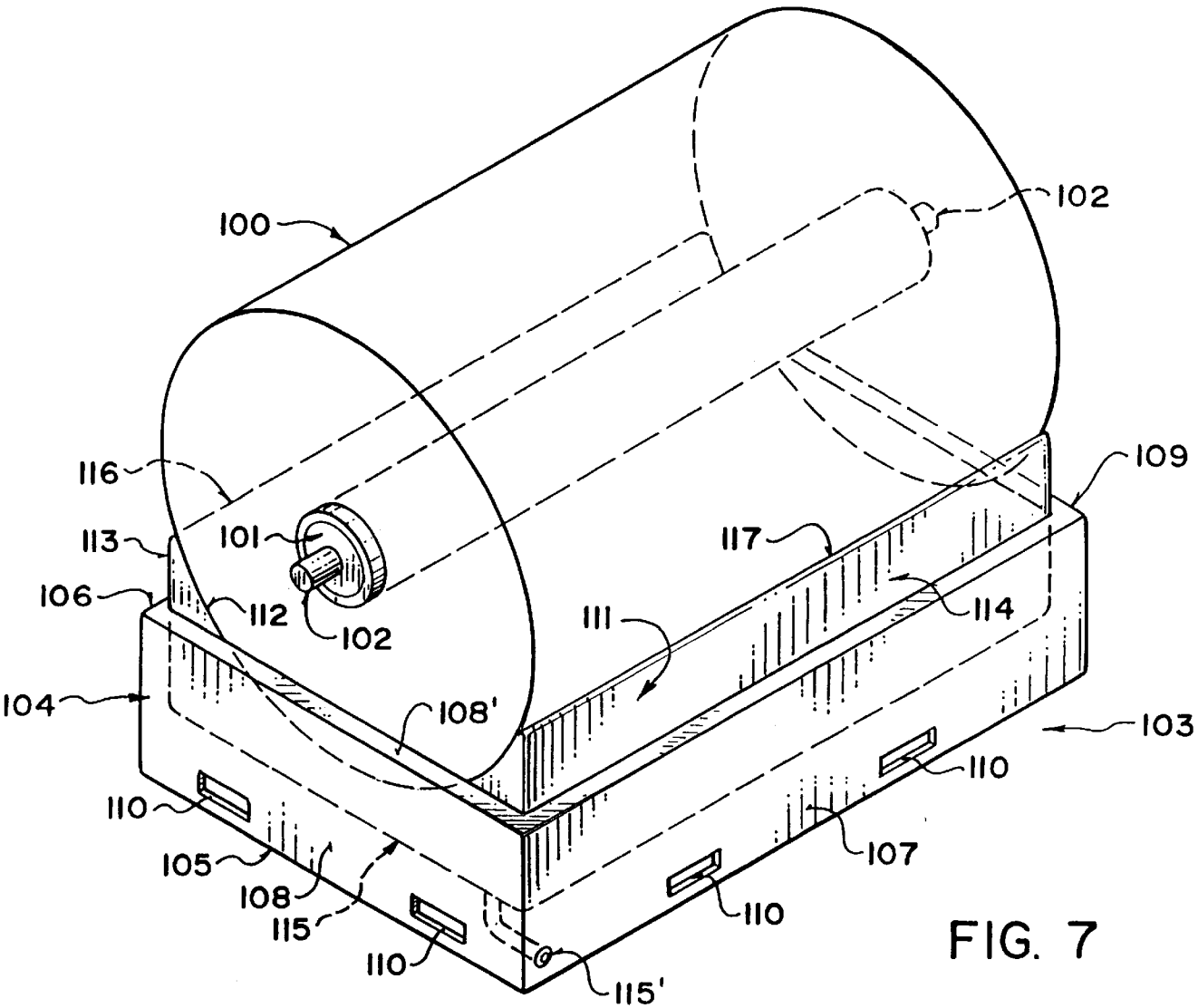
FIG. 7 is a cross sectional view of a second embodiment of support stand according to the present invention.

Turning now to FIG. 7, there is shown a second embodiment of the present invention which includes a large package 100 of the construction and arrangement previously described. The package is formed on a core 101 with end shaft portions 102. In this embodiment the package is wound on a winding stand located at the supply location. Thus the core 101 is supported on fixed arms at the supply location and those arms are separate from the transportation stand shown in FIG. 7. The package is wound using a drive system and lay on roller as previously described up to completion of the package structure. When the package is completed a transportation stand 103 is brought into position underneath the package for supporting the package during its handling, storage and transportation. The transportation stand comprises a rigid base 104 with a bottom surface 105, upstanding sides 106 and 107 and an open top 108. The side walls 106 and 107 together with end walls 108 and 109 each contain receptacles or slots 110 for receiving forks of a conventional fork lift handling system.

Within the base 103 is provided an inflatable cradle assembly 111 with an upper surface 112 together with side walls 113 and 114 and a bottom wall 115. A hollow interior within the inflatable cradle can be filled with air from an inflation valve 115. Thus when there is no air inside the inflatable cradle, the top surface simply collapses down onto the bottom surface and is housed wholly within the rigid base. However when the air is inserted into the hollow interior, the cradle inflates to the shape as shown which has a curvature matching the outside surface of the package so as to support the package between top edges 116 and 117 of the cradle and over an arc around the package structure and over a substantially full length of the package structure. Thus the whole package structure is cradled on the air bed provided by the inflatable membrane system.

With the package so supported, the arms (not shown) supporting the core 101 are removed so that the whole of the package structure is supported on the cradle without the necessity for support of the core.

The package structure can be wrapped in a cover as previously described. The package structure is thus protected and supported against damage and can be transported on the rigid base from the supply location to a storage location, through transportation to a storage location at the end use location and then moved into position at an unwind station similar in construction to the winding station.

Figure 11:
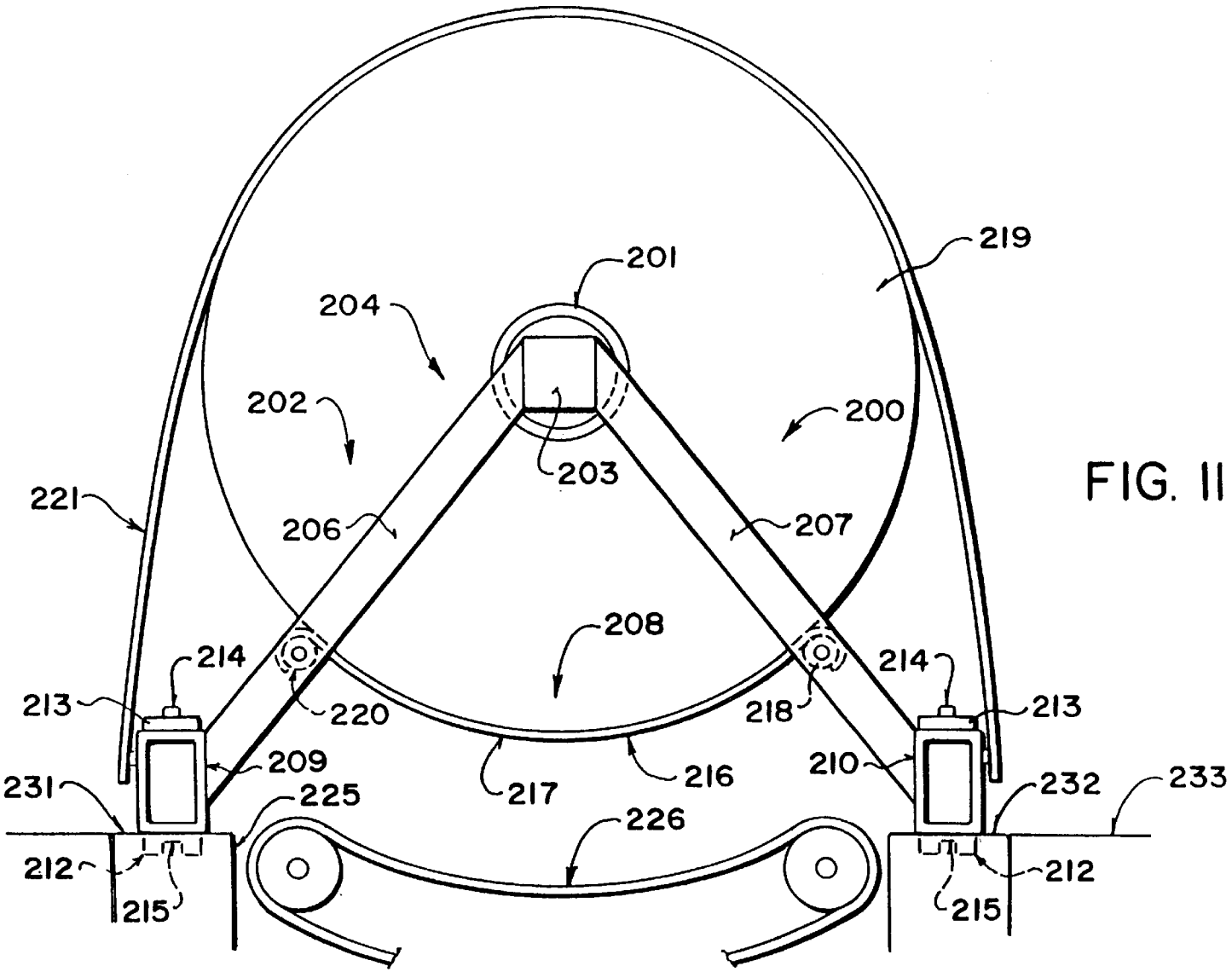
FIG. 11 is a side elevational view of a further embodiment of support stand according to the present invention for use in a method according to the invention of winding, transporting and unwinding a package.
Figure 12:
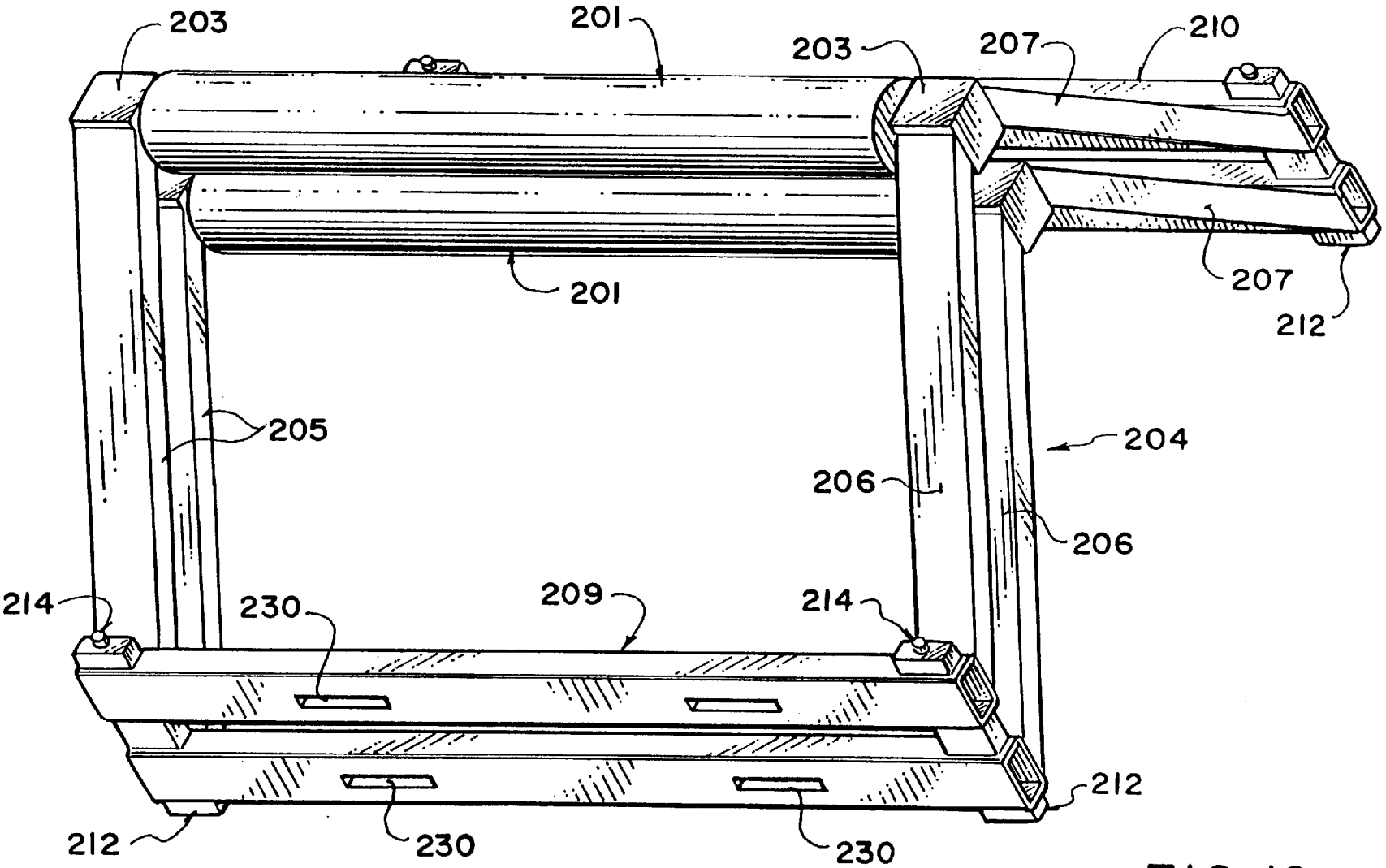
FIG. 12 is an isometric view showing two support stands of the arrangement shown in FIG. 11 in stacked relation for return after the package is unwound.

Turning now to FIGS. 11 and 12 there is shown an alternative arrangement for supporting the roll of the structure as previously described.

This support stand operates in the same manner as previously described except that it is a rigid structure which avoids the complexity of moving parts and provides rigid structural members which thus can provide the necessary strength. In this arrangement the frame is generally of inverted V shape so that without folding, the supporting stands can be stacked each on top of the next as shown in FIG. 12.

The support stand generally indicated at 200 comprises the elongate support roller 201 carried on a rigid support frame structure 202. The ends of the roller 201 are carried in a rectangular mount 203 which is supported at the necessary height from the ground by two end frames 204 and 205. Each end frame comprises a pair of rigid struts 206 and 207 which are inclined outwardly and downwardly from the rectangular support 203 leaving a central area 208 between the struts 206 and 207 which is open. Thus the struts form a generally inverted V-shape. The bottom of the struts is attached to a pair of side rails 209 and 210 each of which extends along the full length of the frame and is attached to the end frame structures 204 and 205 to provide a rigid interconnected strong frame of sufficient strength to support the roll during winding, unwinding, transportation and storage.

This arrangement allows the full length of the elongate roll 201 to be of the order of 7 feet while leaving enough space between the ends of the frame and as clearance within a transportation container to allow the full width of the structure to be inserted in the transportation container across the width of the container.

Each rail 209, 210 includes a pair of support pads 212 and its underside and a pair of support pads 213 on its upper side. The support pads 213 include a projecting pin 214 which engages into the recess 215 of the pad 212 of the next stand stacked on top. Thus the pins 214 locate the stands in the stacked position.

A cradle 216 is formed from a sheet 217 carried on a supply roller 218 mounted on the legs 207 and extending across the full width of the frame. The sheet 217 can be wound onto the roller 218 in a stored position and can be stretched out underneath the package structure 219 to a wind up roller 220 attached across the legs 206. The wind up roller can be tensioned by a suitable ratchet and lever arrangement (not shown) so as to pull the sheet up underneath the package structure to hold it in place. The rollers 218 and 220 can be removed from suitable mountings on the legs 206 and 207.

During transportation, thus the package is supported on the roll 201 and on the cradle 217 and is covered by a cover 221 arched over the package and attached to the rails 209 and 210.

Depending upon the type of material used in forming the package, the cradle may in some cases may be omitted or removed since such materials may not sag sufficiently to present an unwinding problem.

The pads 212 are arranged to be located in locating members at the winding and unwinding station as previously described. The pads thus act as registration elements to accurately locate the package structure. The rails span an opening 225 in a floor structure providing space for a winding/unwinding assembly 226 similar to that previously described. Thus the winding assembly 226 is located in the opening 225 and can be moved upwardly on a suitable support frame (not shown) into engagement with the underside of the package for engaging and rotating the package during winding or unwinding. Thus the package can be supported during unwinding to prevent sagging when the material requires such support. Transfer of support from the cradle to the cradling drive system 226 can be effected by lifting of the drive system underneath the cradle and then by winding the cradle onto one of its support rollers.

The use of the rigid non-collapsible support stand avoids the provision of moving parts and pivot arrangements which could otherwise require extensive strengthening to support the significant weight of the package structure. This arrangement also allows the drive for rotation of the package to be located underneath. Stacking is effected by inserting the roller of one stand into the open area 208 underneath the next adjacent stand.

The side rails 209 and 210 include receptacles 230 for the forks of a conventional fork lift system so that the stand can be lifted and carried on the forks. The package structure is arranged so that its lowermost point is above the forks across the rails but otherwise is as close as possible to the ground to avoid significant increasing height of the package structure above its nominal diameter of eight feet.

In addition the pads 212 allow the side rails to be engaged into transport rail members 231 and 232 arranged in a floor structure 233 so that the package structure on its stand can be moved by the rail 231 and 232 from the storage location to the unwind location. This avoids the necessity for fork lift trucks to move the structure around and allows an increased level of automation.

In an alternative arrangement (not shown) the pads 212 can carry castor wheels which allow the structure including the stand and the package to be rolled around as a trailer or pushed in front of an automated robot unit which moves the structure from the storage location to the unwind location and from the winding location to a transportation location.

Turning now to the embodiment shown in FIGS. 13, 14, 15 and 16, there is shown an alternative form of stand which acts to support the package during winding, storage and transportation and unwinding. The stand basically provides the cylindrical core on which the package is wound which is held at a fixed height for carrying the package thereon together with a cradle arrangement which support the periphery of the package during storage and transportation with the stand having the capability to the intermeshed with other stands to reduce the volume of the stands when formed in a row each intermeshed with the next.

It is important that the stand be of simple economic construction using what is in effect minimum materials so that the stand can be manufactured cheaply and can itself have a low weight.

Figure 14:
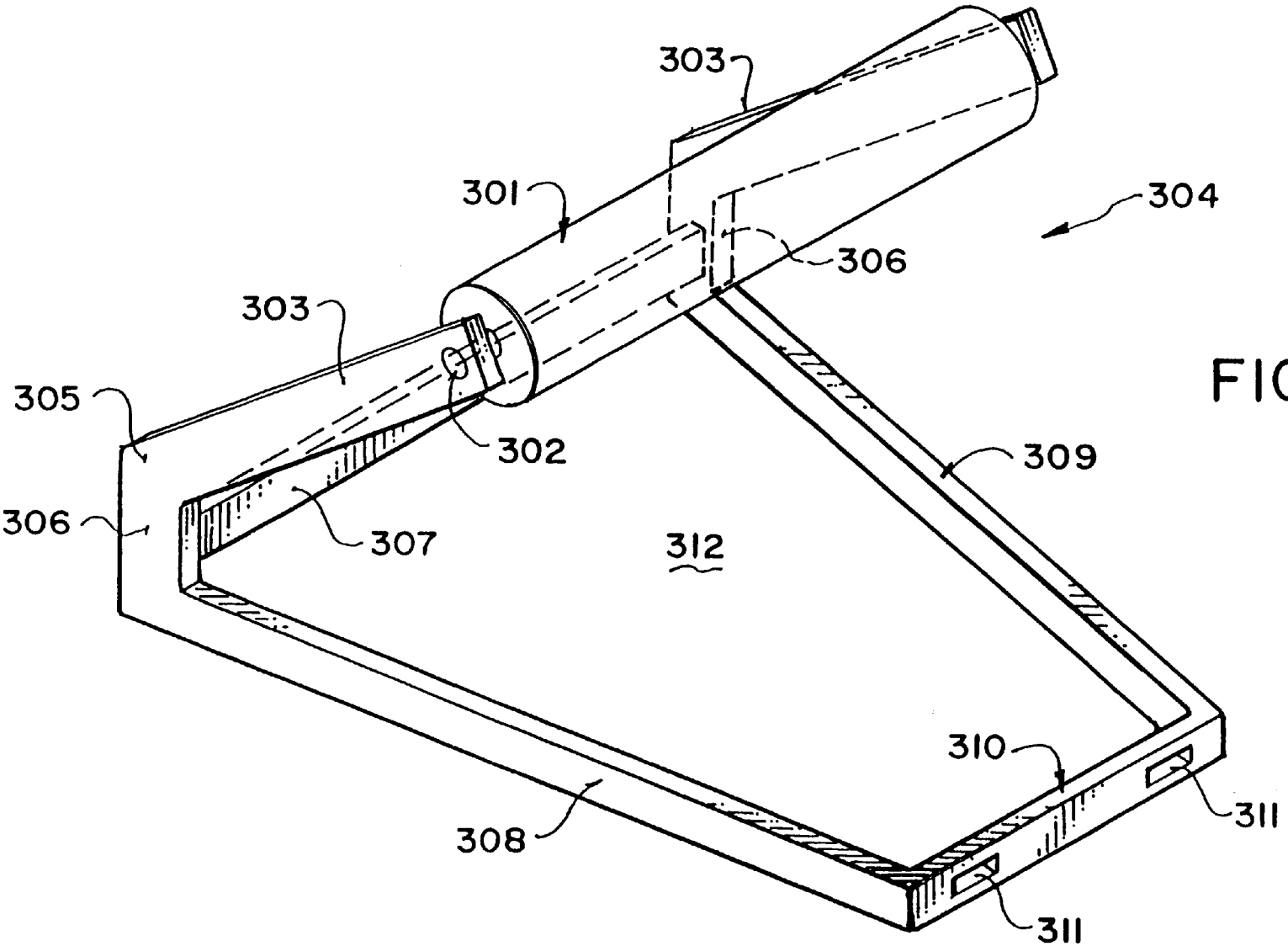
FIG. 14 is an isometric view of the stand of FIG. 13 with the full package and cradle structure for supporting the package removed.
Figure 15:
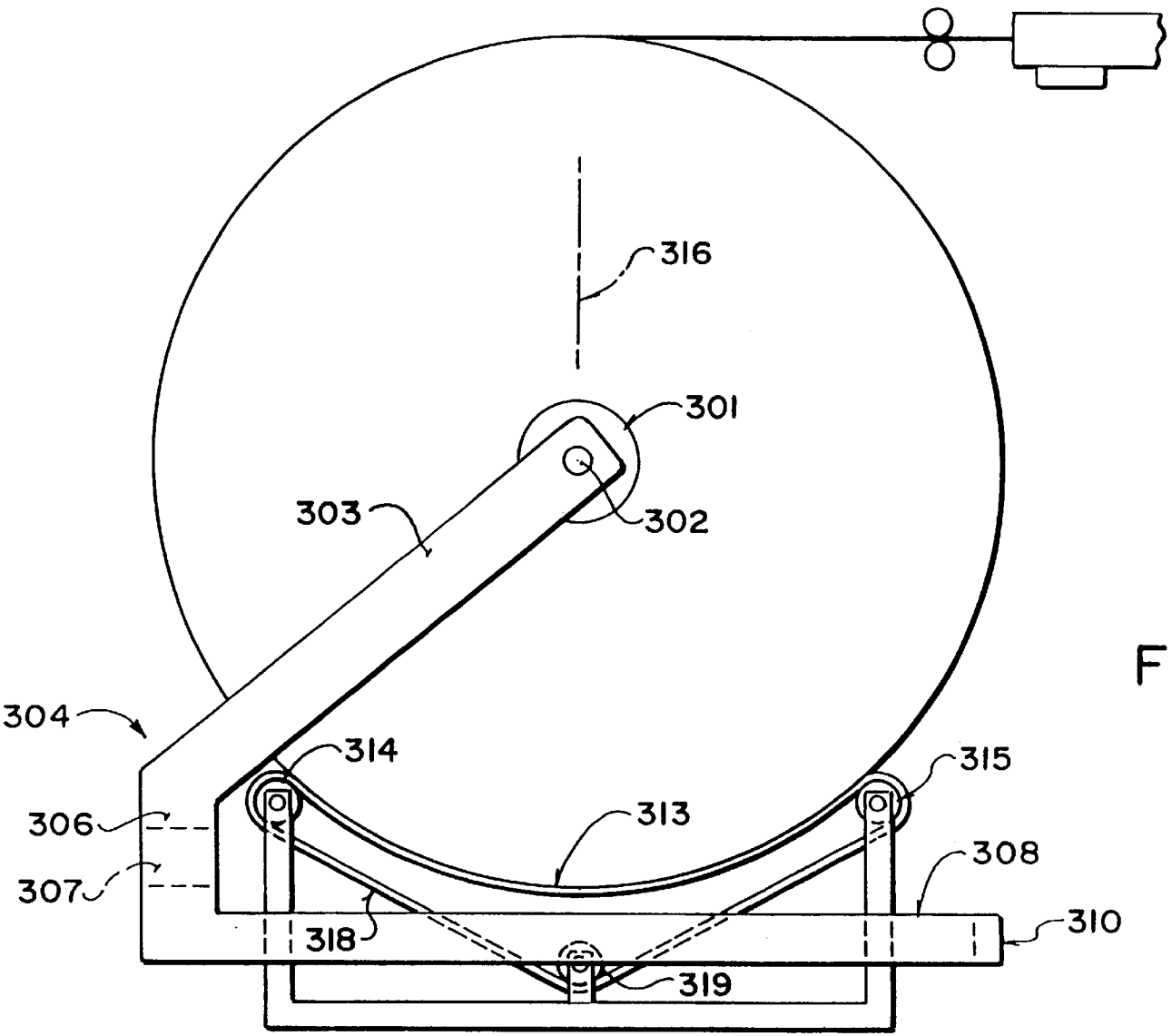
FIG. 15 is a side elevational view of the stand of FIG. 13 at the unwinding station with the cradle structure for supporting the package removed ready for unwinding.

The basic stand as shown in isometric view in FIG. 14 comprises the cylindrical core 301. The core is supported on bearings 302 with those bearings being mounted on two frame arms 303 each at a respective end of the core. The arms 303 are inclined from an upper end at the height of the core downwardly and toward one side of the package to a lower end 305 which connects to a vertical post 306. Thus the weight of the core in this embodiment is cantilevered from the post 306. A bracing of the cantilevered arm 303 can be provided by a fixed web or by a fold down brace which extends from the arm to the lower part of the stand supporting the post 306.

The posts 306 are interconnected by a horizontal beam 307 which extends parallel to the axis of the core 301 and is welded to each of the posts 306 at respective ends of the beam 307. The bottom edge of the beam 307 is spaced upwardly from the bottom of the post 306 so as to spaced upwardly from the ground to allow passage of forks of a forklift underneath the beam to effect lifting of the support stand.

The posts 306 are supported in vertical orientation by a pair of horizontal rails 308 and 309 which extend generally back along the same direction as the arms 303 to an outer connecting rail 310 which is parallel to the beam 307 and located on a side of the axis of the core opposite to the beam 307 so as to provide a stable base for the stand to hold the core above the stand.

The length of the rail 310 is less than the length of the beam 307 so that the rails 308 and 309 converge toward one another. In this way the stand is tapered so as to allow a next adjacent stand to be inserted by sliding the next adjacent stand in a direction at right angle to the axis of the core so that the beam 307 of the next adjacent stand passes over the rail 310 to a position in which the core of the next adjacent stand is immediately adjacent the core of the first stand with the cores at the same height and the stands both resting on the ground. As the rail 308 and 309 converge toward one another, the corresponding rails 308 and 309 of the next adjacent stand lie immediately adjacent but slightly outside the rails 308 and 309 of the first stand. In this way a row of the stands can be formed with the cores parallel and side by side and at the same height.

Depending upon selection of materials and dimensions of the various elements, it may be necessary to provide a supporting web or supporting post for the arms 303. It will be appreciated that a web arrangement can be provided which also tapers inwardly similarly to the rails 308 and 309 so as to transfer some loads between the arm 303 and the rails while the webs are also arranged so that one can slide inside the next. The alternative of fold down post arrangement can be provided where the post lies on top of the respective rail 308, 309 and can move from a folded position lying on top of that rail to a raised position extending upwardly to the respective arm 303.

The rail 310 includes holes 311 through which the forks of a forklift truck can pass so that the forks can pass through the holes 311 and underneath the beam 307 to provide a stable lifting action on the whole of the stand with the package carried thereon.

The amount of taper of the frame structure is the minimum which can be obtained so that the rails 308 and 309 of one stand lie just inside those of the next when the stands are overlapped sufficiently to place the cores adjacent but not touching. In this way there is left an open area 312 between the beam 307 and the rail 310 and between the rails 308 and 309 which is substantially equal to the dimensions of the package. This allows the package to be supported, in the position shown in FIG. 15, during the unwinding and winding operations on a drive belt or belts 313. The drive belt or belts 313 has a width between the rails 308 and 309 which is substantially equal to the axial length of the package. Thus the belt, or a series of separate belts side by side, engage the package along its full length even to the edges of the package to prevent any portions of the package from being damaged by failure to properly be supported.

The drive belt or belts 313 rotate around end rollers 314 and 315 which are spaced apart on either side of the central plane 316 of the package structure containing the axis of the core 301. The spacing of the rollers 314 and 315 is the maximum which can be obtained within the open area 312. The rollers are supported on a suitable frame structure 316 which allows the drive system to be raised and lowered from a storage position underneath a floor surface on which the stand is mounted to a raised position in engagement with the periphery of the package at its initial maximum size and as the size of the package diminishes so that the belt 313 is moved up to a position contacting the core 301. A return run 318 of the belt or belts is guided on an idler roller 319 to allow the belt 313 to change in shape to accommodate the reducing diameter of the package as it is unwound or as it is wound.

Figure 13:
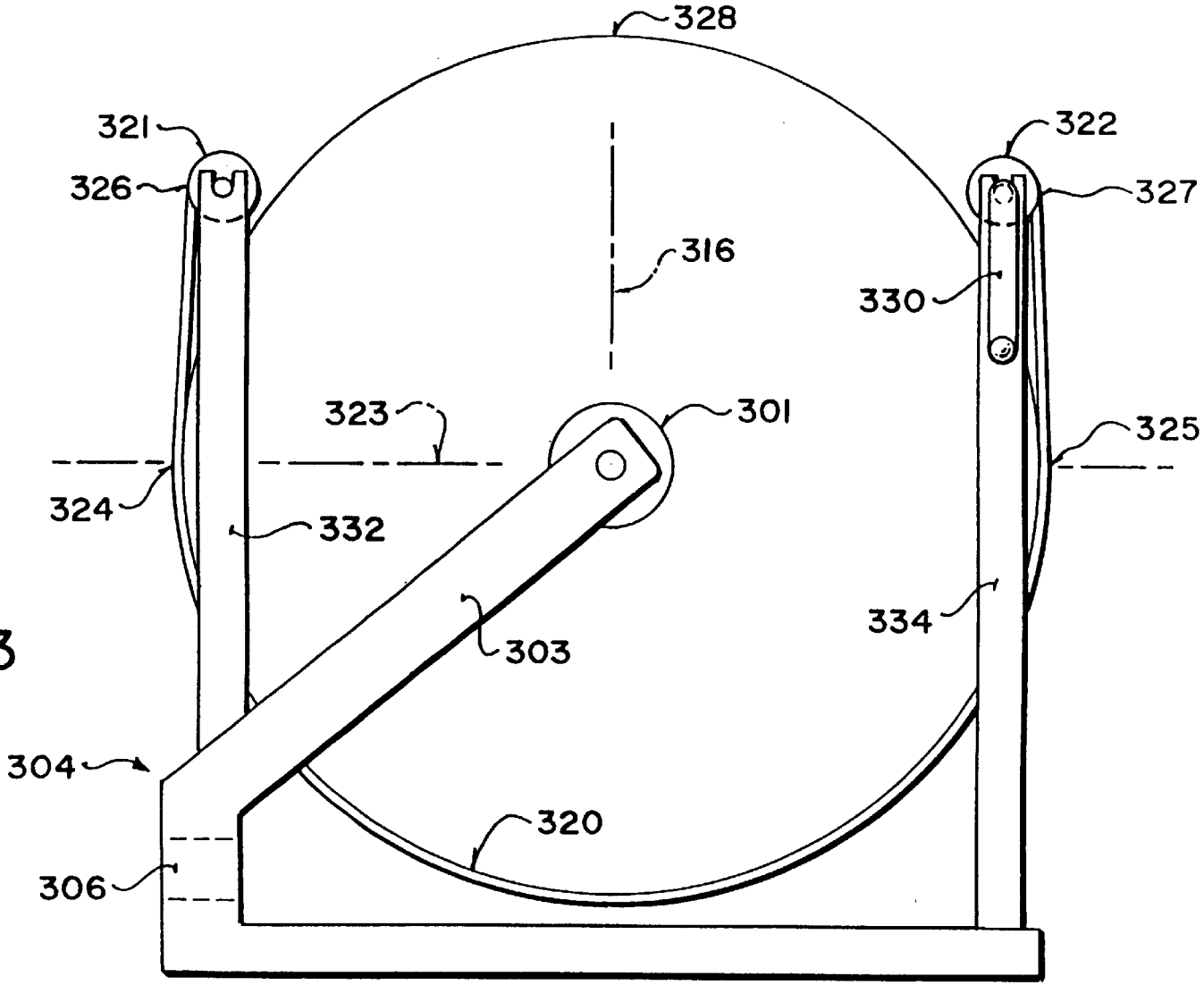
FIG. 13 is a side elevational view of an alternative embodiment of support stand including a full package and a removable cradle structure for supporting the package during storage and transportation.
Figure 16:
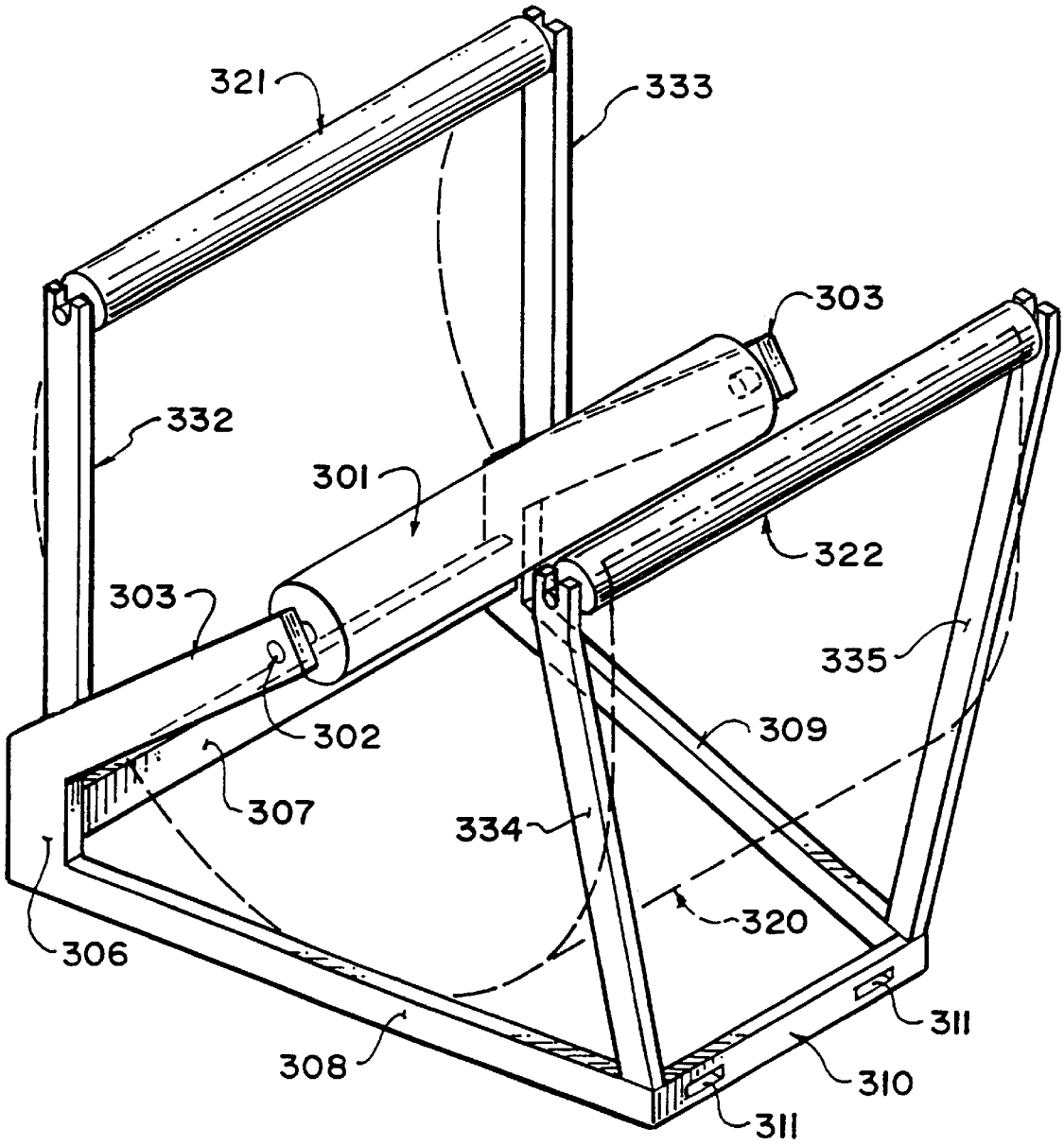
FIG. 16 is an isometric view of the stand of FIG. 13 including the cradle structure for supporting the package but with the package itself omitted for convenience of illustration.

Turning now to FIGS. 13 and 16, there is shown a modification of the cradle arrangement previously described for providing support of the package periphery during storage and transportation. In this embodiment there is provided a cradle or sling 320 similar to the cradle previous described except that it extends around more than one half of the periphery of the package. Thus the ends of the sling are carried on suitable horizontal support members 321 and 322 located at a height above a horizontal plane 323 containing the axis of the core 301. Thus the sling extends around the full periphery from a point 324 in the plane 323 to a second point 325 in the plane 323. From these points the sling extends substantially tangentially to the periphery of the package to a raised point 326, 327 above the points 324 and 325 respectively. In this way the loading on the sling is vertical at the points 326 and 327 which avoids the possibility of applying additional compression inwardly on the package which would occur if the points 326 and 327 were moved inwardly towards the vertical central plane 316.

However the points 326 and 327 and the support members 321 and 322 are located so that they do not project outwardly beyond a vertical plane containing the points 324 and 325. It will be appreciated that the points 324 and 325 represent the maximum dimensions of the package and both the stand and the supports for the cradle are located within these dimensions so that the packages can be stored and transported while avoiding wastage of space between one package and the next package.

For the same reason, the supports 321 and 322 are located below the uppermost apex 328 of the package so that there is no structural element which extends beyond the boundary of the package and thus interferes with the maximum diameter of the package which can be stored and transported.

The arrangement of cradle shown in FIG. 11 can also be used in which the rollers 218 and 220 and moved upwardly and outwardly to the maximum position without projecting beyond the vertical planes tangential to the package surface. This arrangement can also provide a support of the package substantially over 180 degrees.

In order to tension the sling 320, one of the supports 322 is preferably a roller with a handle 330 which allows the roller to be rotated to a required tension of the sling and then the handle is locked in place at a predetermined angle to hold that tension fixed. For this purpose the handle may be a ratchet arrangement or any other suitable device which effects a locking action when the predetermined tension is achieved.

The opposite support 321 can be simply a tube or bar which provides sufficient strength to hold the edge of the sling horizontal.

The supports 321 and 322 can be carried on any suitable structural members which locate them at the required height and at the required position relative to the periphery of the package so that the end portions of the sling are vertical as the extend from the supports to the positions 324 and 325.

In the embodiment shown in FIGS. 13 and 16, the support 321 is mounted on a pair of posts 332 and 333 which extend vertically upwardly from the lower end of the arms 303. The post 332 and 333 may be removable from or hingedly mounted on the arms 303. The support 321 may also be removable from the upper end of the post 332 and 333 for example by simply slipping out of a U-shaped receptacle at the top of the respective post.

Similarly the support 322 is mounted on a pair of posts 334 and 335 which extend vertically downwardly from respective ends of the support 322 and connect with the ends of the rails 308 and 309 respectively. Again the post 334 and 335 may be removable from the end of the respective rail 308, 309 or may be hingedly mounted thereon so they can be folded down to lie on top of the respective rail 308, 309. As the amount of taper necessary for the intermeshing of the stands is minimized so that the length of the rail 310 is as long as possible so that it can still pass within the posts 306, the amount of taper necessary in the posts 334 and 335 is also relatively small allowing the post to lie along side the end surfaces of the package as shown in FIG. 13. Again the support 322 may be removable from a U-shaped receptacle at the top of the posts 334 and 335 to assist in the folding or collapsing action to allow again the stand to be intermeshed with the next adjacent stand without the presence of the support 321 from interfering with the proper intermeshing action.

Figure 20:
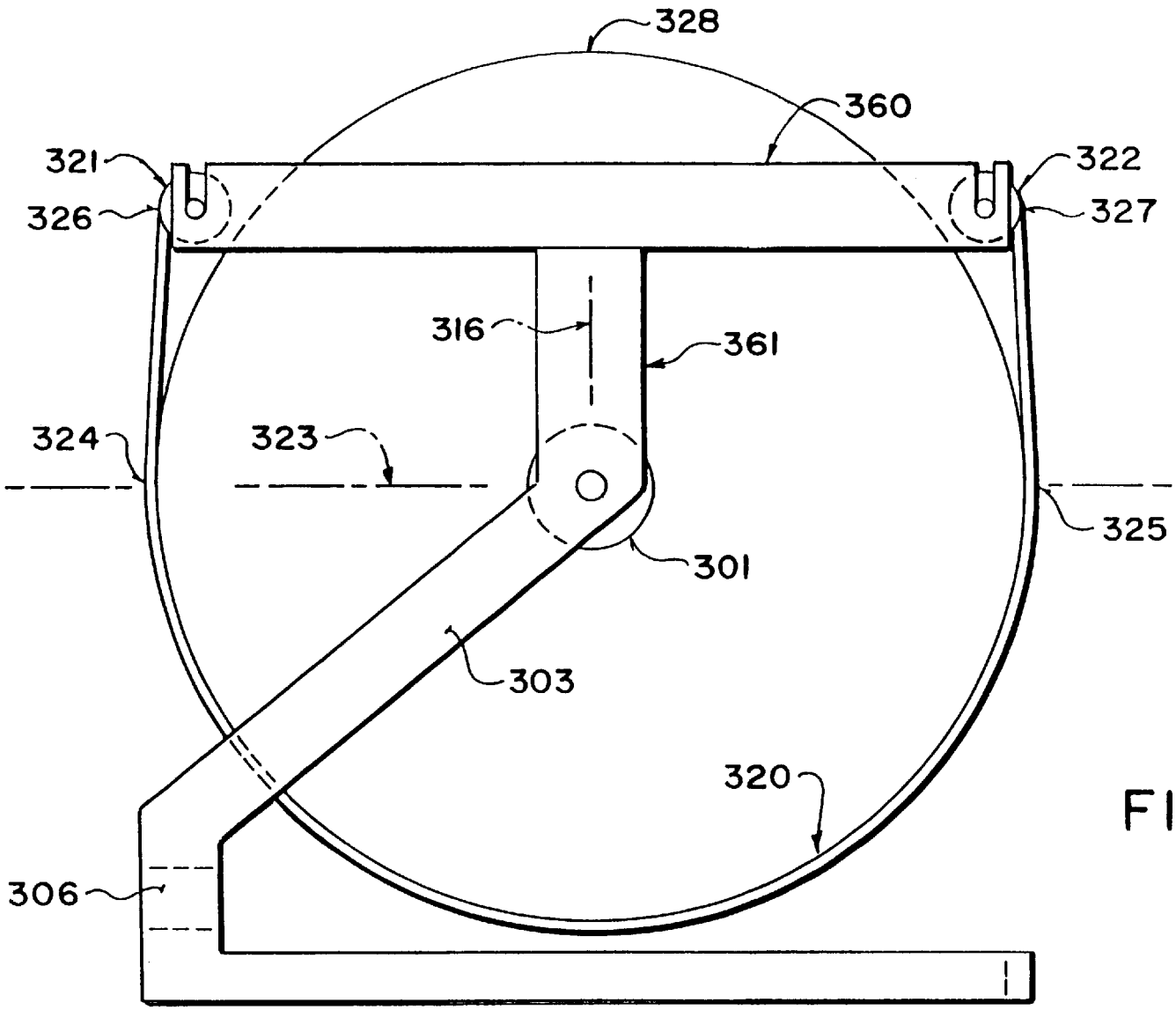
FIG. 20 is a side elevational view of a further alternative embodiment of support stand including a full package on the stand structure which is the same as that of FIG. 13 and using a modified removable cradle structure for supporting the package during storage and transportation.

In an alternative arrangement shown in FIG. 20, the support 321 and 322 may be supported on horizontal side rails 360 each extending along a respective end of the package and each supported from the upper end of the arm 303 by a post 361 which extends upwardly therefrom at the central plane 316. Such a structure may also be folded or removed to allow the intermeshing action. In particular, the post 361 may remain in place since this can be meshed with the next stand but the side rails 260 and the rollers 321 and 322 can be dismantled each from the others and collapsed for separate storage in relatively small space since each is a simple linear element.

Preferable the cradle 320 and also the drive belt 313 supports the whole of the length of the package so that the package can be substantially continually supported during its formation, immediately after formation is completed and during storage and transportation and then it is immediately transferred to the drive belt 313 at the unwinding location. In this way the whole of the package is properly supported at all times. Some structures of package may however require less support and therefore the sling 320 can be divided into separate sling portions each having a width less than the length of the package structure leaving spaces between the sling portions. In such an arrangement the drive belts 313 can be also of reduced width and arranged so that they are located in the spaces between the sling portions. In this way the transfer from the sling to the drive belt is simpler since both can simultaneously be in position supporting the package and the sling is removed to allow the package to be rotated.

In a further alternative arrangement (not shown), the sling can form a continuous belt wrapped over rotatable rollers at the supports 321 and 322 so that the sling can be driven by one of the rollers to continually rotate the package while it sits in the stand. Some particularly sensitive material may require this continual rotation to avoid forces within the package structure from causing tension changes in the strip which can damage the strip structure.

Figure 17:
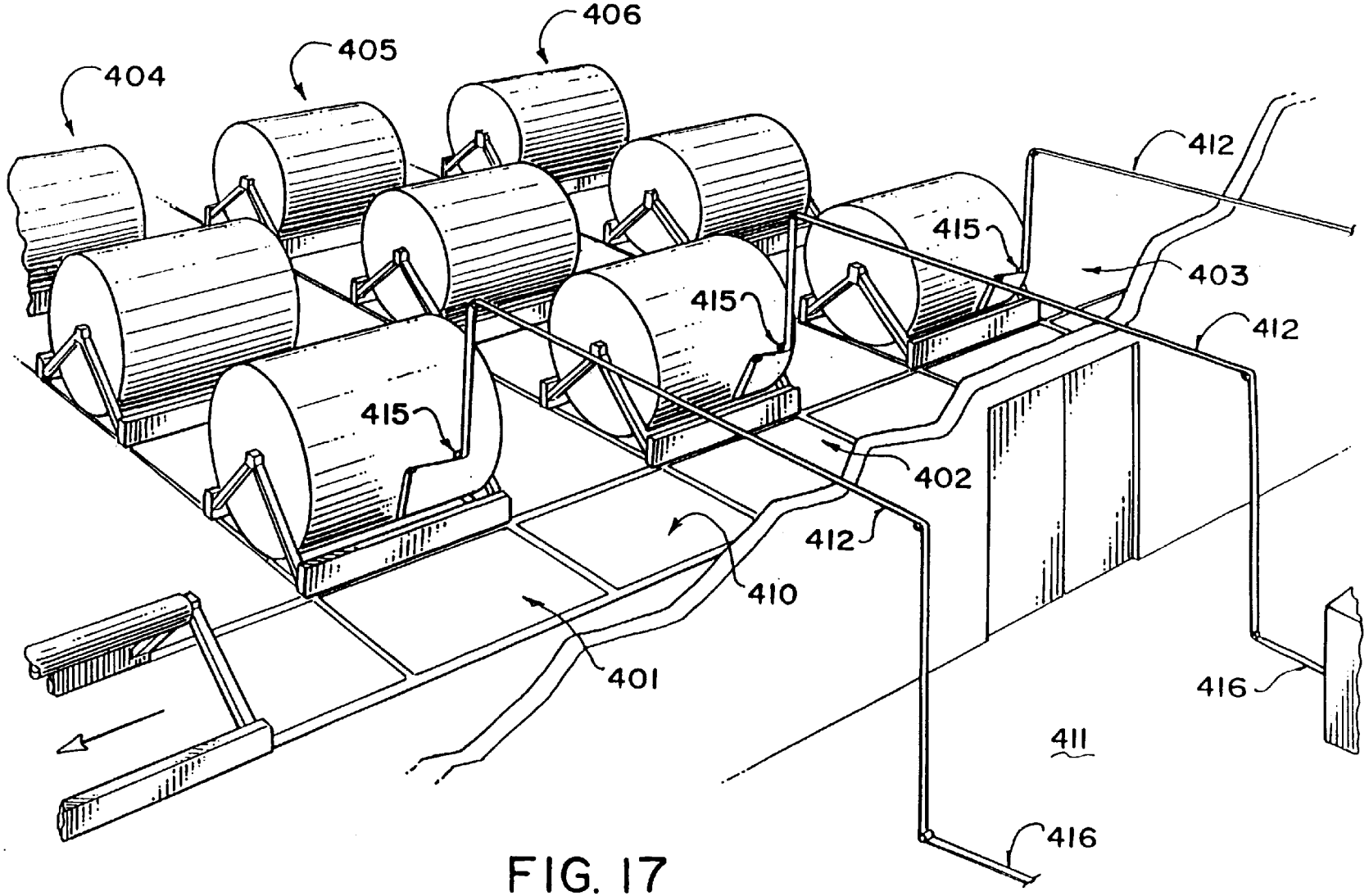
FIG. 17 is an isometric view of a typical installation of the stands at an end use location.
Figure 18:
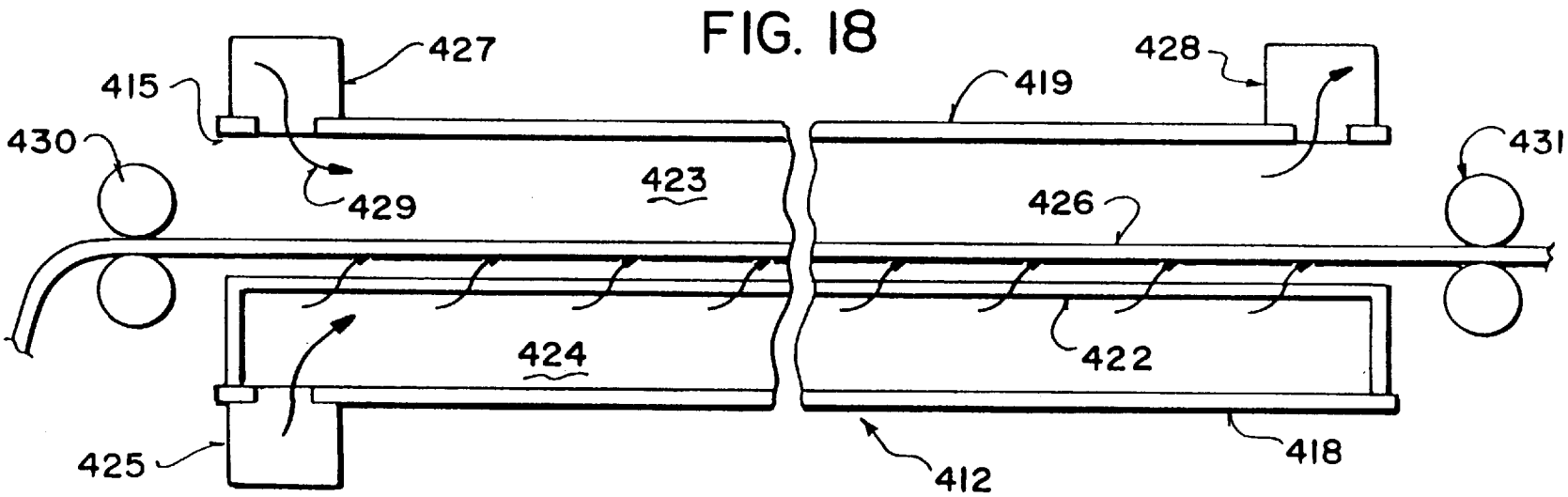
FIG. 18 is a longitudinal cross sectional view through the strip transportation duct of FIG. 17.
Figure 19:
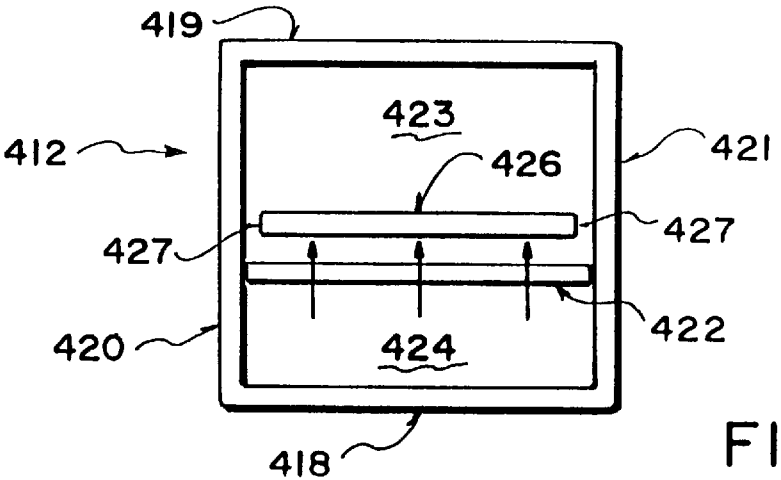
FIG. 19 is a transverse cross sectional view through the strip transportation duct of FIG. 17.

Turning now to FIGS. 17, 18 and 19, it is shown in FIG. 17 a typical installation in which three separate strip materials are supplied on three separate lines 401, 402 and 403 each feeding a separate end use machine. To provide the necessary continuous supply of the strip material each line 401, 402 and 403 has a row of supply packages 404, 405, and 406. Each row contains as shown three such packages with a first one of the packages arranged for actual supply of the strip material at the present time and two more packages arranged in backup for subsequent connection to the tail end of the package when that is exhausted.

Each row has a pair of tracks which allow the support stands to be fed forwardly in a direction generally longitudinal of the supply of the strip material. When the current supply stack is exhausted, its support stand can be moved in a direction at right angles to the strip supply along a further set of rails for movement to a discharge position.

As shown, the supply system including the rails and the rows of packages is located in an area 410 which is separate from the area 411. The supply area 410 can thus be located well away from the end use machines in the area 411 which allows ready transportation of the large packages from a shipping area on the facility. In an existing installation where the arrangement of the machines in the facility reduces or prevents access for transportation of the large packages, the supply area 410 can be provided as a separate holding area as an addition to the existing facility so as to supply strip to existing machines without moving or modifying the machines themselves or the layout of the machines.

The strip is transported from the currently unwinding package to the end use machine through a respective supply duct 412 which has an inlet end 415 adjacent the package and a discharge end 416 at the end use machine.

The duct 412 has sections which extend upwardly, horizontal sections and portions which extend downwardly so that the duct can pass over intervening obstacles. The structure of the duct is shown in more detail in FIGS. 18 and 19 and this comprises a closed tubular member defined by a bottom wall 418, top wall, 419 and two side walls 420 and 421. As shown the duct is rectangular but a circular duct can also be used. The duct is divided by a horizontal membrane 422 into and upper chamber 423 and a lower chamber 424. The membrane 422 is permeable so that air can pass through the membrane. Air is fed into the lower chamber 424 through an air inlet duct schematically indicated at 425 at the feed end 415. Air escapes from the lower chamber 424 through the permeable membrane into the upper chamber 423. The passage of air through the membrane acts to lift the strip 426 off the membrane to allow it to be carried on a cushion of air through the duct thus minimizing any friction of the strip within the duct. Edges 427 of the strip are confined by the sides 420 and 421 so the strip is held in place and prevented from twisting or moving side to side.

The membrane is preferably formed of a material which acts to direct the air in a direction longitudinally of the duct so the air passes through the membrane in an inclined direction upwardly and longitudinally to assist in providing a carrying force on the strip longitudinal of the duct. Such a material may be provided by a fabric having a directional pile such as a velvet type material which is conventionally used as a one way fabric for removing lint and the like from clothing and is available from a US company called Helmac known under the trademark "magic brush".

The duct also includes a threading system schematically indicated at 427, 428. This includes a venturi system and the inlet end 415 forming an air flow 429 directed along the duct in the upper chamber 423. A suction outlet 428 is provided at the other end so as to withdraw the air from the upper chamber. During threading, the air flow can be increased dramatically using the threading system to carry an initial length of the strip through the duct until the threading is complete, for than which the threading system can be halted and the strip simply carried on the cushion generated through the membrane.

The duct extends along the full length between a set withdrawing rollers 430 at the package and a set of feed rollers 431 at the end use machine. The rollers 430 and 431 are controlled to run at identical feed speeds to ensure that the strip is as far as possible supplied at a constant rate. Any tension changes between the rollers can be accommodated by slight stretching or release of the strip. It may be possible therefore to avoid the necessity for an accumulator in the system.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A winding support stand for supporting a package structure during winding of a strip into the package structure at a supply location, during transportation of the package structure from the supply location to an end use location and during unwinding of the package structure for supply of the strip to an end use machine at the end use location, the stand comprising:

a stand base;

an elongate cylindrical support member mounted on the stand base for rotation about a longitudinal axis of the member for receiving thereon the strip to form the package structure and for unwinding of package structure to supply the strip;

a flexible sling for engaging and supporting an outer surface of the package structure to inhibit sagging of the package structure;

the sling having a first end support and a second end support each arranged parallel to the axis of the elongate member and each located at a height on the support stand at least as high as the axis such that the sling extends around substantially 180 degrees of arc of the package.

2. The winding support stand according to claim 1 wherein the first and second end supports are arranged such that the sling extends around the package over the angle substantially equal to 180 degrees and extends from the package substantially vertically upwardly therefrom.

3. The winding support stand according to claim 1 wherein the first and second end supports are each arranged inwardly of a vertical plane tangential to the package, below a horizontal plane tangential to the top of the package and above a horizontal plane tangential to the package.

4. The winding support stand according to claim 1 wherein the first and second end supports are carried by support members attached to the stand base for transportation therewith.

5. The winding support stand according to claim 4 wherein the support members are collapsible to allow nesting of one support stand with another for return when the package is unwound.

6. The winding support stand according to claim 1 wherein one of the first and second end supports comprises a roller which is rotatable about its axis to effect winding of the sling onto the roller.

7. A winding support stand for supporting a package structure during winding of a strip into the package structure at a supply location, during transportation of the package structure from the supply location to an end use location and during unwinding of the package support structure for supply of the strip to an end use machine at the end use location, the stand comprising:

a stand base;

an elongate cylindrical core mounted on the stand base for rotation about a longitudinal axis of the member for receiving thereon the strip to form the package structure and for unwinding of package structure to supply the strip;

the stand base including first and second end support arms each for supporting a respective end of the core;

first and second rails each connected to a bottom of a respective arm and each extending across the stand base from said one side of the core to the opposed side underneath the core for resting upon a floor surface;

each arm being cantilevered from the respective rail;

the rails being arranged to converge toward one another from a wider side of the stand base at the bottom of the arms to a narrow side of the stand base as the arms extend across underneath the core;

and the stand base being shaped by the arrangement of the arms and the rails to allow nesting of one stand base with another stand base by insertion of the rails at the narrower side between the rails at the wider side to a position in which the core of one stand base is parallel to and along side the core of the next adjacent stand base.

8. The winding support stand according to claim 7 wherein the rails are connected at the narrower side by a cross rail and wherein the bottom of the arms are connected at the wider side by a cross beam, wherein the cross rail passes underneath the cross beam into the nesting position.

9. The winding support stand according to claim 7 wherein the cross rail has slots therein for the forks of a forklift.

10. A method for supplying a strip to an end use machine at an end use location comprising:

forwarding the strip from a supply thereof at a supply location;

providing at the supply location a winding support stand having an elongate support core mounted on the stand for rotation about a longitudinal axis of the core;

causing a rotation of the core about the axis while effecting a traversing movement of the strip back and forth along the core so as to effect winding of the strip onto the core to form a package of the strip;

effecting transportation of the package structure from the supply location to the end use location;

causing unwinding of the package structure at the end use location so as to supply the strip to the end use machine;

providing at the end use location an end use machine;

at the end use location locating the package structure at a position remote from the end use machine;

and transporting the strip from the package structure to the end use machine through a transportation duct;

and providing in the duct an air flow therethrough tending to carry the strip on a layer of air within the duct.

11. The method according to claim 10 wherein the duct is a tube surrounding the strip.

12. The method according to claim 10 wherein the duct includes a permeable sheet over which the strip passes with air flowing through the sheet to form said layer of air.

13. The method according to claim 10 wherein there is provided an additional air flow system for threading the strip through the duct.

14. The method according to claim 10 wherein the sheet includes one way fibers tending to cause movement of the air and strip downstream of the duct.

15. The method according to claim 10 wherein the package structure is maintained supported on the winding support stand during said transportation and said unwinding until the elongate member is emptied and effecting a return of the winding support stand with the emptied elongate member from the end use location to the supply location.

* * * * *